US007214080B2

(12) United States Patent
Ichio et al.

(10) Patent No.: US 7,214,080 B2
(45) Date of Patent: May 8, 2007

(54) CONNECTOR AND A CONNECTOR ASSEMBLY

(75) Inventors: Toshifumi Ichio, Yokkaichi (JP); Takehiro Nakata, Yokkaichi (JP); Michiaki Okamoto, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 11/519,584

(22) Filed: Sep. 12, 2006

(65) Prior Publication Data

US 2007/0059970 A1 Mar. 15, 2007

(30) Foreign Application Priority Data

Sep. 14, 2005 (JP) ..... 2005-267408
Oct. 3, 2005 (JP) ..... 2005-289996

(51) Int. Cl.
*H01R 13/64* (2006.01)

(52) U.S. Cl. ..... 439/248; 439/358; 439/246

(58) Field of Classification Search ..... 439/246, 439/247, 248, 357, 358
See application file for complete search history.

(56) References Cited

U.S. PATENT DOCUMENTS 3,094,364 A * 6/1963 Liagg ..... 439/247
4,697,859 A * 10/1987 Fisher, Jr. ..... 439/246
5,329,262 A * 7/1994 Fisher, Jr. ..... 333/33
5,336,540 A 8/1994 Kato et al.
5,516,303 A * 5/1996 Yohn et al. ..... 439/248
6,454,577 B1 * 9/2002 Yi ..... 439/108
7,090,521 B2 * 8/2006 Nishio et al. ..... 439/248

FOREIGN PATENT DOCUMENTS

| | | |
|---|---|---|
| EP | 1 170 872 A1 | 10/2006 |
| JP | 5-50113 | 7/1993 |
| JP | 7-21139 | 8/1995 |
| JP | 63-257187 | 10/1998 |
| JP | 10-294157 | 11/1998 |
| JP | 2005-174813 | 6/2005 |
| WO | WO/2005/064754 | 7/2005 |

* cited by examiner

*Primary Examiner*—Tho D. Ta
(74) *Attorney, Agent, or Firm*—Gerald E. Hespos; Anthony J. Casella

(57) ABSTRACT

A female connector (F) is provided with an outer housing (10) in the form of a bottomed tube, a spring member (50) to be accommodated in the outer housing (10), and an inner housing (30) to be accommodated in the outer housing (10) to sandwich the spring member (50) between the inner housing (30) and a back wall (12) of the outer housing (10) and adapted to hold female terminal fittings (80). The inner housing (30) is pushed by a male connector (M) to move toward the back wall (12) and is floating-supported between the back wall (12) and the male connector (M) via the spring member (50) to move in connecting directions when the male connector (M) is fitted into the outer housing (10) to be locked therein. Upon an occurrence of vibration, the inner housing (30) is capable of moving while following movements of the outer housing (10).

12 Claims, 32 Drawing Sheets

CONNECTOR AND A CONNECTOR ASSEMBLY

BACKGROUND OF THE INVENTION

1. Field of the Invention

The invention relates to a connector, to a connector assembly and to an assembling method therefor.

2. Description of the Related Art

Japanese Unexamined Patent Publication No. S63-257187 discloses a connector assembly with female and male connectors that are connectable with each other. The female connector has a terminal accommodating portion for holding female terminal fittings. An outer tube surrounds the terminal accommodating portion. A seal ring is mounted on the outer surface of the terminal accommodating portion at a position inside the outer tube. The male connector has a tubular receptacle and male terminal fittings with tabs that project into the receptacle. The surrounding wall of the receptacle is inserted into a clearance between the seal ring and the outer tube when the connectors are connected. As a result, the seal ring is squeezed in the thickness direction to provide sealing between the connectors.

The above-described connector assembly may be used in a high vibration environment, such as in an engine compartment of an automotive vehicle. Vibrations may cause the connectors to shake relative to each other. This shaking can cause the terminal fittings to abrade and can impair contact reliability between the terminal fittings. The seal ring fills the clearance between the connectors, but may not suppress the shaking sufficiently.

U.S. Pat. No. 5,336,540 discloses another connector assembly with female and male connectors that are connectable with each other. The female connector includes a housing and a resiliently deformable lock arm extends back on the housing. The male connector has a housing with an interlocking portion at a position corresponding to the lock arm. A lock projection of the lock arm engages the interlocking portion to hold the two housings in a properly connected condition.

The housing with the lock arm is likely to be formed from a resin that has lower hardness than resin of the housing with the interlocking portion. Vibration or heat generated after the housings are connected may cause the lock projection of the lock arm to deform due to creep of the resin resulting from the contact with the interlocking portion. Thus, a locking function may be reduced and may cause shaking between the housings. Shaking can impair the contact reliability between male and female terminal fittings in the housings.

The invention was developed in view of the above problem and an object thereof is to increase the lifetime and operability of the connector.

SUMMARY OF THE INVENTION

The invention relates to a connector that has an outer housing and an inner housing accommodated in the outer housing. The inner housing is adapted to hold at least one terminal fitting. A resilient member is sandwiched between portions of the inner and outer housings and supports the inner housing for floating movement in connecting directions of the connector with a mating connector. The inner housing can be pushed by the mating connector as the mating connector is fit in the outer housing and moves towards a portion of the outer housing. Accordingly, vibration-related abrasion of terminal fittings is suppressed to increase the life and operability of the connector.

The outer housing preferably is substantially tubular and has one end at least partly closed by a back wall. The back wall is the portion of the outer housing for sandwiching the resilient member.

The mating connector preferably can be locked in the outer housing.

At least one receiving portion preferably is on the inner surface of the outer housing, and at least one latch is on the outer surface of the inner housing. The latch contacts the receiving portion to mount the inner housing substantially rigidly in the outer housing before the mating connector is connected. Thus, the inner housing can be set correctly at a connection position with the mating connector while having the shaking restricted. However, the latch and the receiving portion are separated from each other by a movement of the inner housing during connection with the mating connector. Thus, the substantially rigidly mounted state of the inner housing is canceled, and the inner housing is supported for loose floating movement.

One of the latch and the receiving portion preferably includes a loose movement preventing portion for surrounding the other of the latch and the receiving portion before the mating connector is connected. The loose movement preventing portion prevents the inner housing from loosely moving at an angle to the connecting direction. The loose movement preventing portion slides on the outer surface of the other of the latch and the receiving portion during connection with the mating connector. Accordingly, the inner housing moves to a loose movement permitting space that permits loose movements of the inner housing after the mating connector is connected. As a result, the inner housing and the mating connector are held coaxially, and the inner housing can smoothly follow the movement of the mating connector.

At least three supports preferably are arranged at substantially even intervals around the periphery of the resilient member and resiliently press the pressable surface of the inner housing towards the mating connector. Thus, the resilient forces of the supports are dispersed evenly over substantially the entire periphery of the inner housing to prevent displacement of the inner housing from the central axis of the mating connector.

The mating connector preferably has a receptacle with a surrounding wall that is insertable into a space between the inner surface of the outer housing and the outer surface of the inner housing. A flange bulges out at a position on the outer surface of the inner housing to face the leading end of the surrounding wall of the receptacle in the connecting direction. A seal is mounted adjacent the flange and is squeezed between the outer surface of the inner housing and the inner surface of the surrounding wall of the receptacle after the mating connector is connected. A deformation preventing portion is provided at a bulging end of the flange and faces the seal for pressing the surrounding wall of the receptacle from an outer side after the mating connector is connected to prevent a widening deformation thereof. Thus, shaking of the receptacle can be suppressed after the mating connector is connected and the sealing ability of the seal remains good.

One of the mating connector and the outer housing preferably has a resiliently deformable lock arm, and the other has an interlocking portion. Engagement of the lock arm with the interlocking portion holds the mating connector in the outer housing. Corresponding parts of the outer housing and the mating connector both are made of synthetic resins. However, the resin for the interlocking portion is harder than the resin for the lock arm. Thus, there is a possibility that the force of the resilient member will deform a surface of the lock arm that contacts the interlocking portion due to creep of the resin. Accordingly, a locking function could be reduced and shaking could occur between the housings. A reinforcing plate covers at least part of a surface of the lock arm that contacts the interlocking portion to prevent creep of the resin.

One of the mating connector and the outer housing preferably has at least one lifting portion that is displaceable as the lock arm is moved, and the other thereof includes at least one interacting portion at a position adjacent the interlocking portion. The lifting portion moves onto the interacting portion to lift the lock arm during the connection of the mating connector so that the lock arm and the interlocking portion do not interfere with each other. Thus, the interlocking portion is not abraded by the reinforcing plate of the lock arm, and a satisfactory locking function is maintained.

The lock arm preferably is on the outer housing, the resilient member preferably is a metallic leaf spring, and the reinforcing plate is formed by extending a part of the leaf spring along a surface of the lock arm. The extension of the reinforcing plate from the resilient member reduces the number of parts. Further, disposition of the reinforcing plate along the inner surface of the lock arm reinforces the lock arm over a wide range.

The invention also relates to a connector assembly comprising at least one pair of male and female connectors as described above.

These and other objects and advantages of the invention will become more apparent upon reading the following detailed description and accompanying drawings. Even though embodiments are described separately, single features may be combined to additional embodiments.

DETAILED DESCRIPTION OF THE PREFERRED EMBODIMENTS

Figure 1:
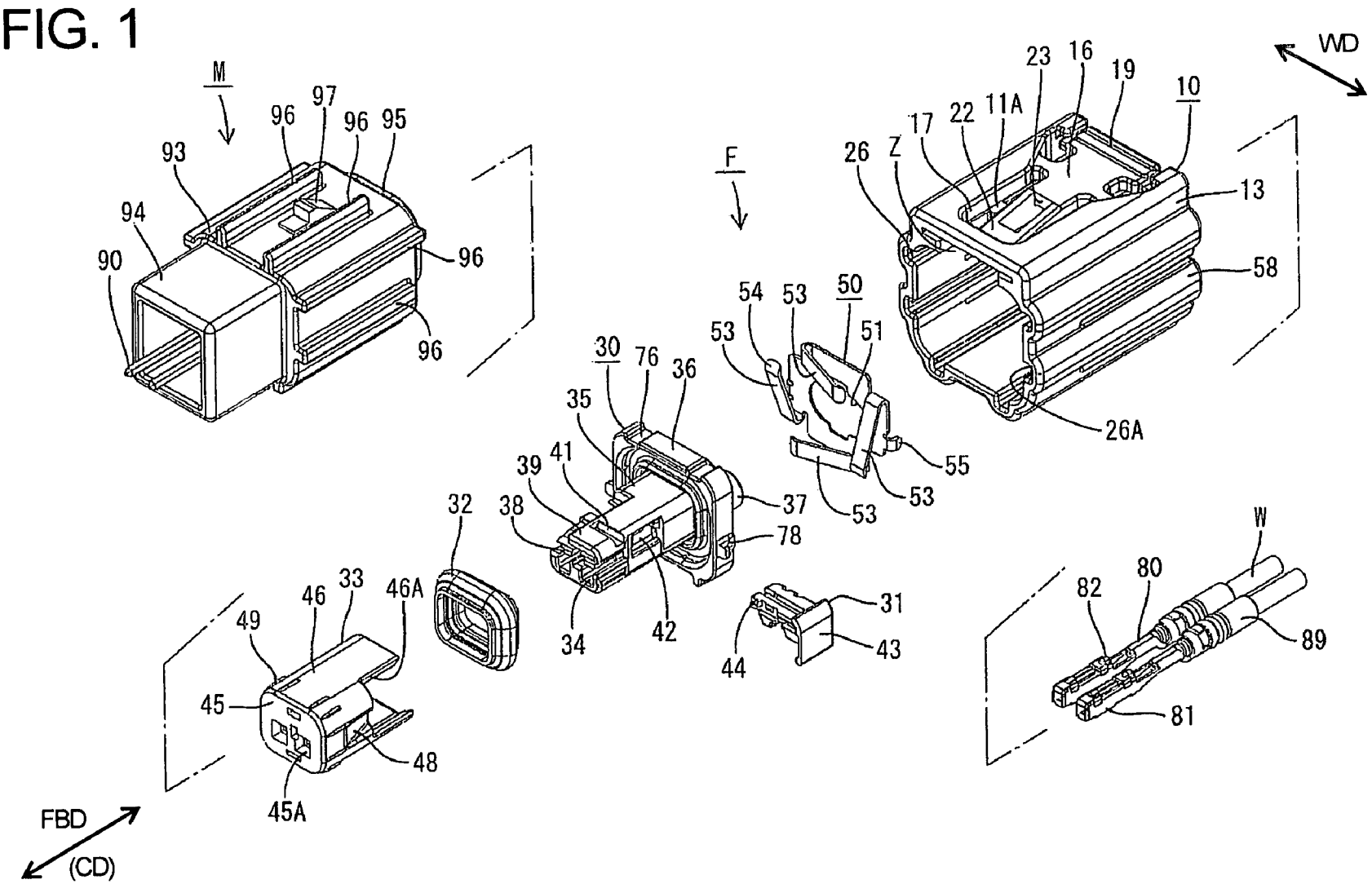
FIG. 1 is an exploded perspective view of male and female connectors according to a first embodiment.

A connector assembly according to a first embodiment of the invention includes female and male connectors F and M that are connectable with one another as shown in FIGS. 1 to 18. In the following description, ends of the connectors F, M that are connected are referred to as front ends and reference is made to FIGS. 1 and 2 concerning the vertical direction.

The male connector M is made e.g. of a synthetic resin, and is to be mounted directly on a wall of an unillustrated apparatus, such as a junction box, an instrument panel, a housing of an electric appliance, etc. The male connector M includes straight male terminal fittings 90. A terminal holding portion 92 extends substantially normal to forward and backward directions FBD and the male terminal fittings 90 are inserted through and held in the terminal holding portion 92. A rectangular tubular receptacle 93 projects forward from the peripheral edge of the terminal holding portion 92, and a substantially rectangular tube 94 projects back from the peripheral edge of the terminal holding portion 92. Front ends of the male terminal fittings 90 project into the receptacle 93, rear ends thereof project into the rectangular tube 94, and intermediate parts thereof penetrate the terminal holding portion 92.

The leading end of the surrounding wall of the receptacle 93 has an outer surface that is cut to be a thin pushing portion 95. Eight elongated guide ribs 96 extend in substantially forward and backward direction FBD on the surrounding wall of the receptacle 93 and are spaced from one another around the periphery of the surrounding wall of the receptacle 93. Rear ends of the guide ribs 96 are substantially at the rear end of the receptacle 93, while the front ends of the guide ribs 96 are behind the front end of the receptacle 93. An interlocking portion 97 projects on the upper surface of the surrounding wall of the receptacle 93 and a slanted guiding surface 97A slopes up and back on the front of the interlocking portion 97. A substantially vertical locking surface 97B is formed on the rear of the interlocking portion 97. Two guide ribs 96 are arranged on the upper surface of the surrounding wall of the receptacle 93 at opposite sides of the interlocking portion 97. The front ends of the guide ribs 96 are behind the front end of the receptacle 93.

The female connector F has a rectangular tubular outer housing 10 and a substantially rectangular block-shaped inner housing 30, each of which is made e.g. of a synthetic resin. The inner housing 30 is adapted to hold female terminal fittings 80 connected with ends of wires W and is disposed within the outer housing 10 so that a forwardly open connection space Q is defined between the outer and inner housings 10 and 30. The female connector F also has a spring 50 disposed between rear ends of the inner and outer housings 30 and 10. Further, a retainer 31, a seal 32 and a front member 33 are assembled with the inner housing 30, as shown in FIG. 1.

Figure 4:
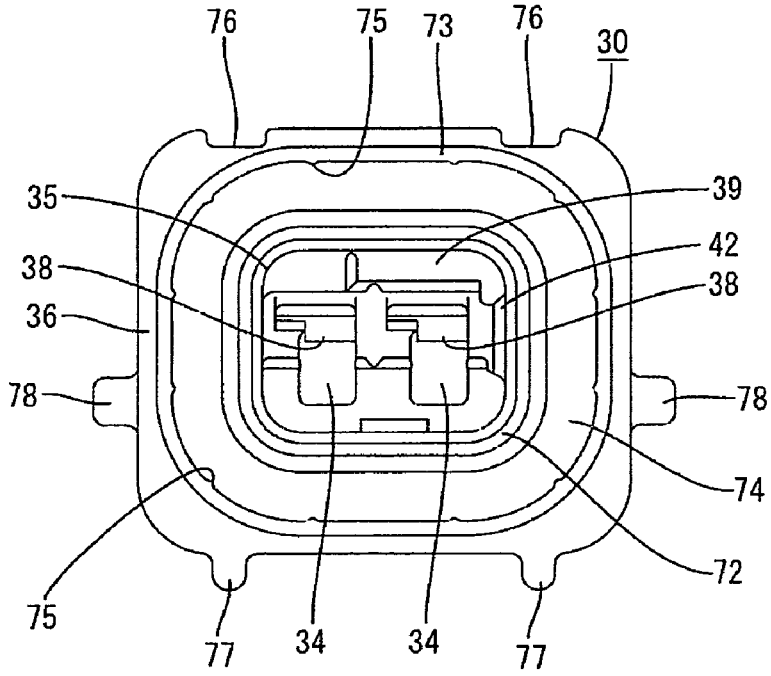
FIG. 4 is a front view of an inner housing.
Figure 5:
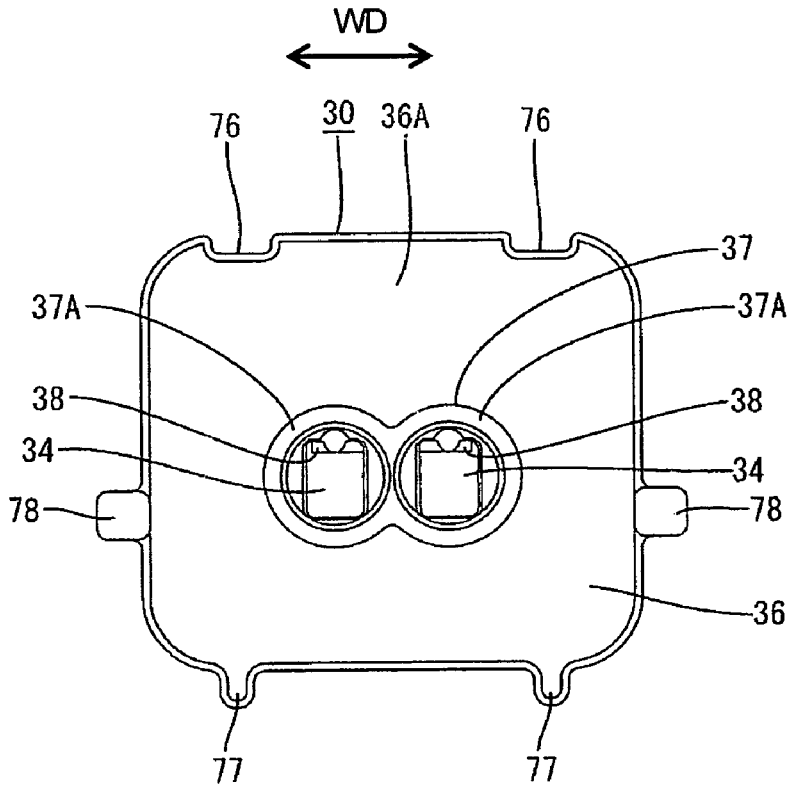
FIG. 5 is a rear view of the inner housing.
Figure 6:
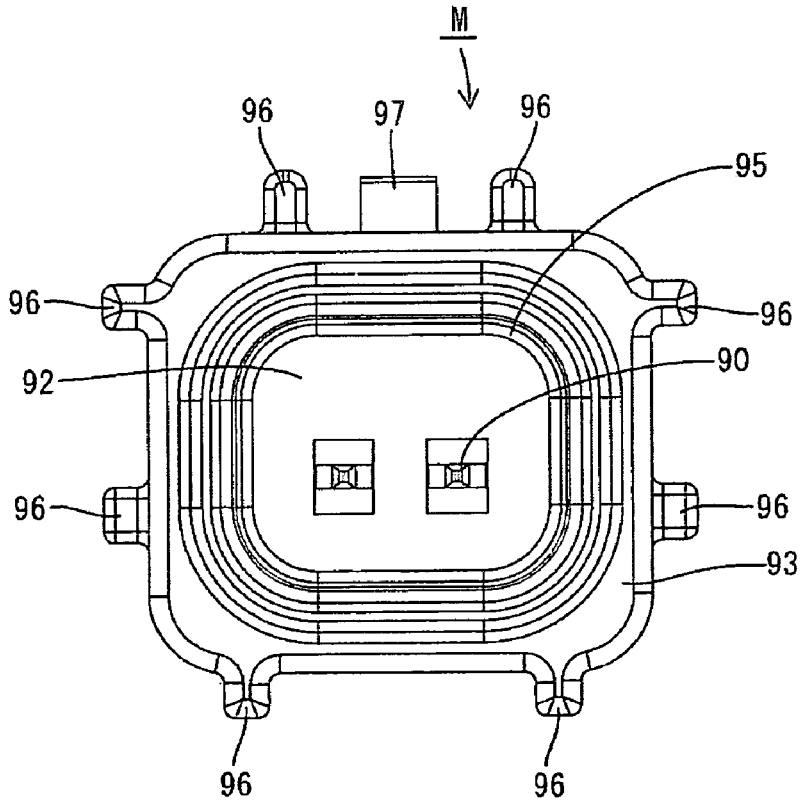
FIG. 6 is a front view of the male connector.

The inner housing 30 has a main portion 35 with two side-by-side terminal accommodating chambers 34 as shown in FIGS. 4 and 5. A flange 36 bulges out from the outer peripheral surface of the rear end of the main portion 35 and extends over the entire periphery. A terminal inserting portion 37 projects back from the rear end of the main portion 35 and communicates with the terminal accommodating chambers 34. The terminal inserting portion 37 has two round tubes 37A that extend in forward and backward directions FBD. The walls of the tubes 37A are joined in forward and backward directions FBD.

Figure 7:
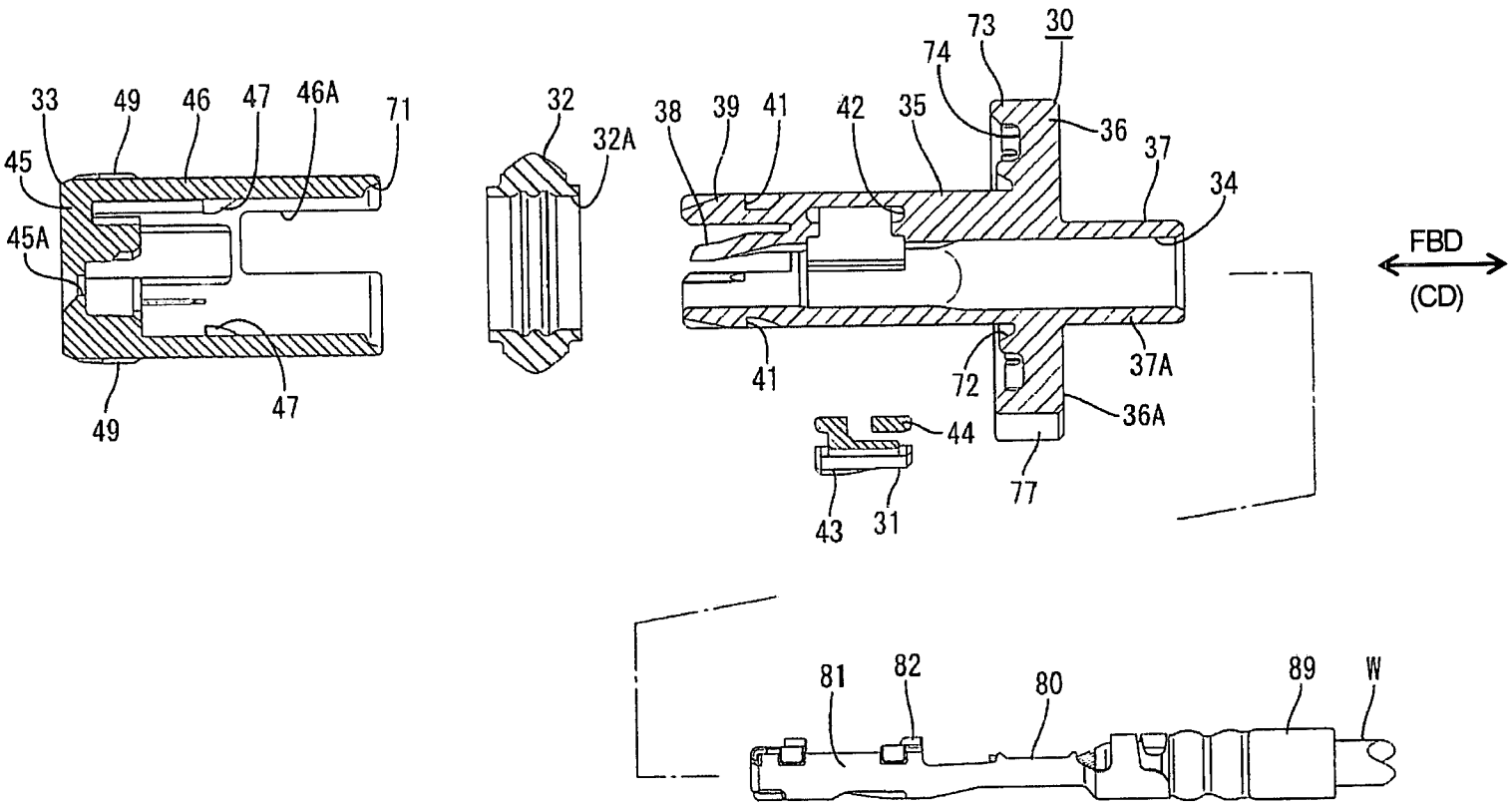
FIG. 7 is a side view in section of the inner housing and parts to be assembled with the inner housing.

As shown in FIG. 7, a lock 38 is cantilevered forward from the upper wall of each terminal accommodating chamber 34 of the main portion 35. The locks 38 are resiliently deformable up and down in directions intersecting an insertion direction of the terminal fittings 80 into the female connector F. The left lock 38 (when viewed from front) is exposed, whereas the right lock 38 (when viewed from front) is covered by a cover 39 above a deformation space therefor. The cover 39 is in the form of an eave with a base end connected with the rear end of the main portion 35. An upper front-member locking groove 41 extends in the width direction WD on the upper surface of the cover 39 for locking the front member 33. Similarly, a lower front-member locking groove 41 is formed in the bottom surface of the main portion 35 substantially facing the cover 39. A mount hole 42 opens in opposite side surfaces of the main portion 35. The mount hole 42 penetrates the terminal accommodating chambers 34 in the width direction WD under the cover 39. The mount hole 42 also opens in the lateral upper surface of the main portion 35 at one side of the cover 39.

The retainer 31 is a side-type retainer made e.g. of a synthetic resin. The retainer 31 includes a flat plat-shaped operable portion 43 that can close the opening at one end of the mounting hole 42. A comb-shaped terminal locking section 44 projects from a plane surface of the operable portion 43. The retainer 31 is movable between a partial locking position where the retainer 31 is inserted into the mount hole 42 of the main portion 35 to permit the insertion and withdrawal of the female terminal fittings 80 and a full locking position where the terminal locking section 44 locks the female terminal fittings 80.

The front member 33 is made e.g. of a synthetic resin and has a cap-shape. The front member 33 includes a front wall 45 for covering the front end of the main portion 35, and a surrounding wall 46 that projects back from the periphery of the front wall 45 to cover the sides of the main portion 35. The front wall 45 has terminal insertion openings 45A at positions corresponding to the terminal accommodating chambers 34. The male terminal fittings 90 can be inserted into the terminal insertion holes 45A from the front and guided into the terminal accommodating chambers 34. Retaining projections 47 are provided on inner surfaces of the upper and lower walls of the surrounding wall 46, and engage the corresponding front-member locking grooves 41. Specifically, the retaining projections 47 fit resiliently in the front-member locking grooves 41 as the front member 33 is mounted to a proper depth on the main portion 35. Thus, the front member 33 is locked on the inner housing 30.

A rear end portion of the surrounding wall 46 is recessed to form an insertion opening 46A that can communicate with the mount hole 42. Thus, the retainer 31 can be inserted and withdrawn through the insertion opening 46A. A jig inserting portion 48 is formed on the surrounding wall 46 and inclines in toward the insertion opening 46A. The retainer 31 can be displaced from the full locking position by inserting an unillustrated jig along a sloped surface of the jig inserting portion 48. Protrusions 49 are spaced from one another around the periphery of the surrounding wall 46. The protrusions 49 engage the inner surface of the receptacle 93 of the male connector M to prevent shaking relative to the male connector M.

The seal 32 is ring-shaped and is made of a resilient material, such as rubber. The seal 32 is mounted on the outer peripheral surface of the rear end of the main portion 35 at a position immediately before the flange 36. An introducing hole 32A extends through the middle of the seal for receiving the main portion 35. A middle part of the seal 32 with respect to forward and backward directions FBD bulges out transverse to the forward and backward directions FBD while the front and rear ends of the seal 32 are thinned on the outer surface. The thinned front end of the seal 32 can fit into a recess 71 at the front edge of the surrounding wall 46 of the front member 33, and the thinned rear end of the seal 32 can fit into a groove 72 in the front surface of the flange 36. In this way, the seal 32 is prevented from moving from the outer surface of the inner housing 30.

The groove 72 is formed over the entire periphery at the base end of the front surface of the flange 36 substantially continuous with the main portion 35. Further, a deformation preventing portion 73 projects forward at the bulging end of the flange 36, and a recess 74 is formed inside the deformation preventing portion 73 for receiving the pushing portion 95 of the receptacle 93 of the male connector M. The seal 32 is squeezed resiliently between the surrounding wall of the receptacle 93 and the main portion 35 to provide hermetic sealing. A force could act on the pushing portion 95 of the receptacle 93 to widen the opening of the pushing portion 95 due to the resilient force of the seal 32. However, the deformation preventing portion 73 presses the pushing portion 95 from an outer side to hinder widening of the pushing portion 95. As shown in FIG. 4, biting projections 75 are spaced apart around the inner periphery of the deformation preventing portion 73. The biting projections 75 bite in the outer surface of the pushing portion 95 of the receptacle 93 to hold the receptacle 93 transversely.

Figure 14:
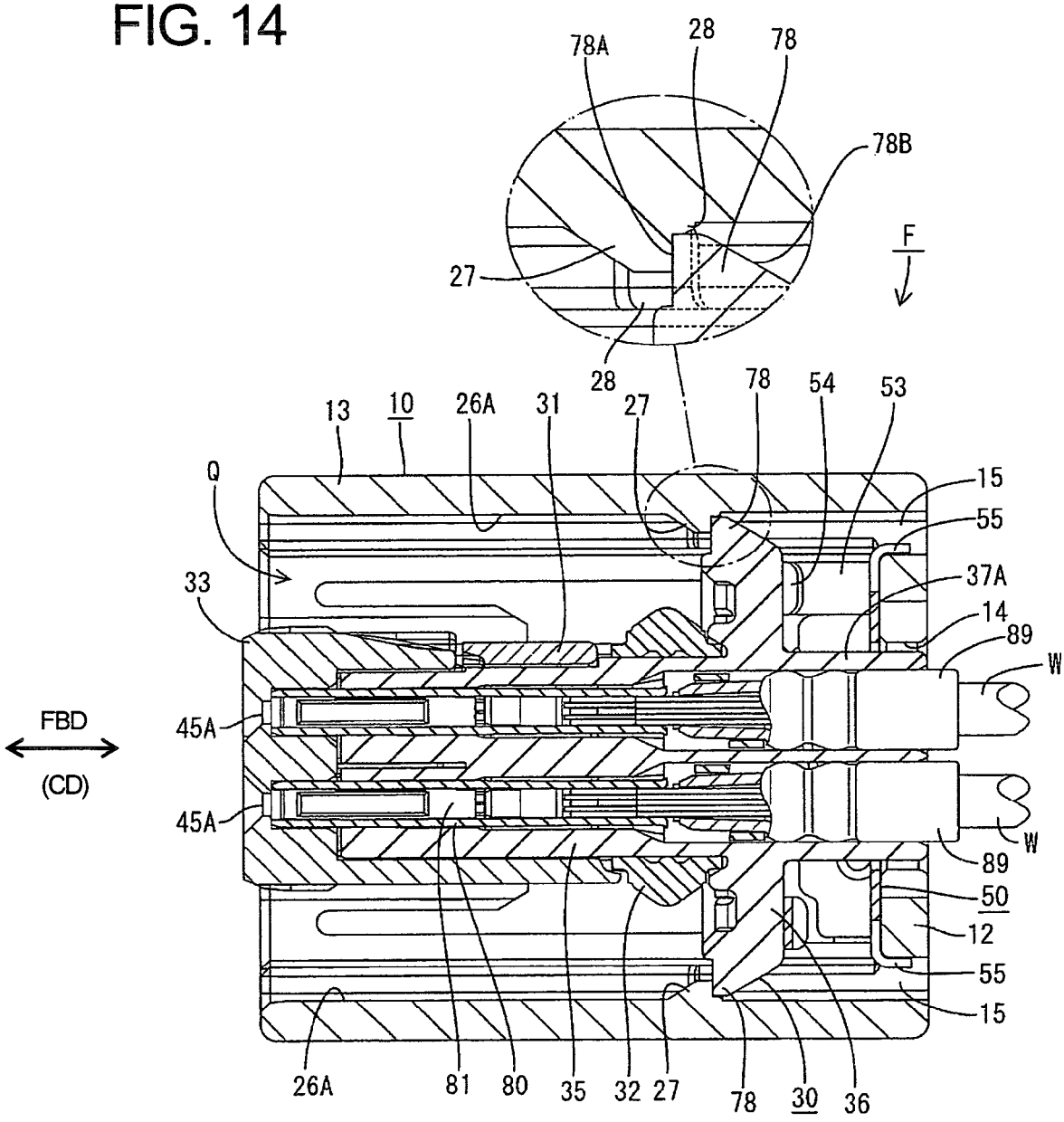
FIG. 14 is a horizontal section of the female connector.

Two recessed grooves 76 are formed in the upper part of the bulging end surface of the flange 36 and are spaced apart in the width direction WD, whereas two guide ribs 77 are formed on the bottom part of the bulging end surface of the flange 36 and are spaced part in the width direction WD. Two latches 78 project from the opposite lateral parts of the bulging end surface of the flange 36. As shown in FIG. 14, each latch 78 is engageable with a corresponding receiving portion 29 in the outer housing 10. The front surface of each latch 78 is a substantially vertical locking surface 78A and the rear surface thereof is a guiding surface 78B that slopes up towards the front.

Figure 10:
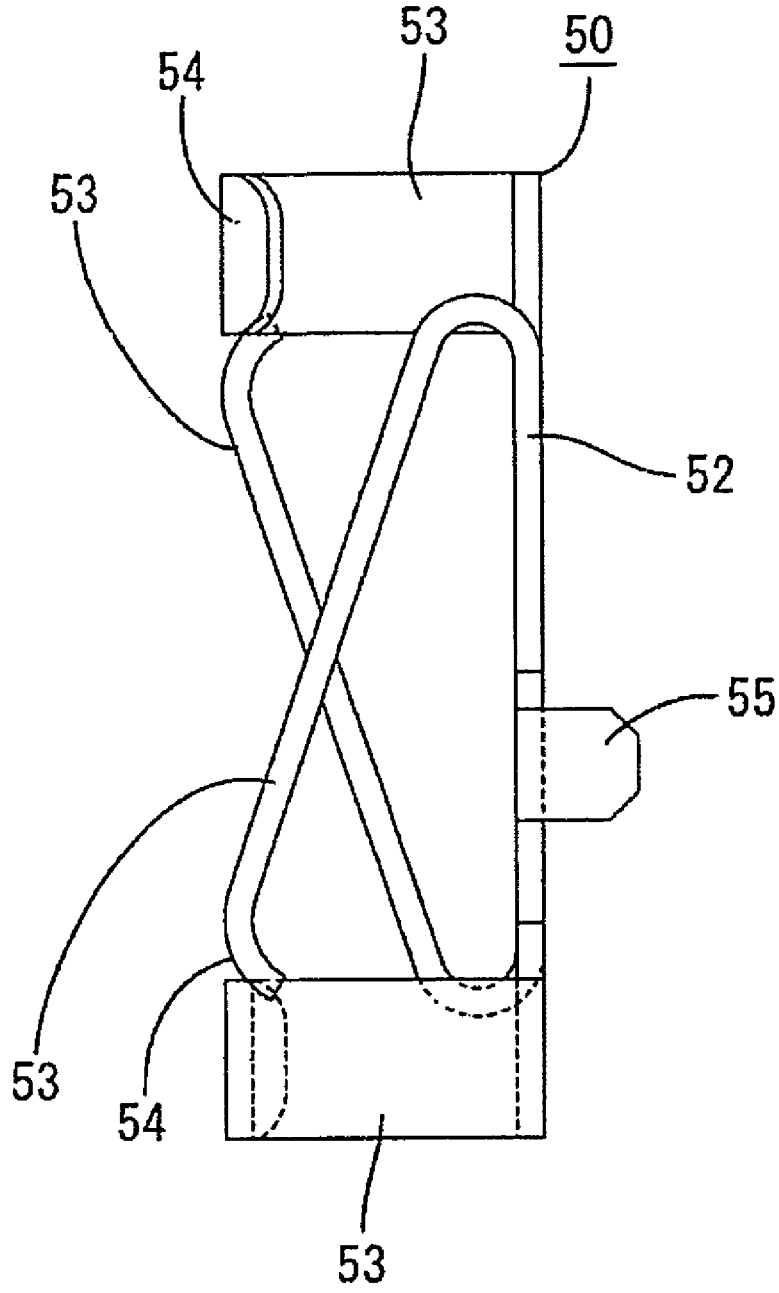
FIG. 10 is a side view of a spring member.
Figure 11:
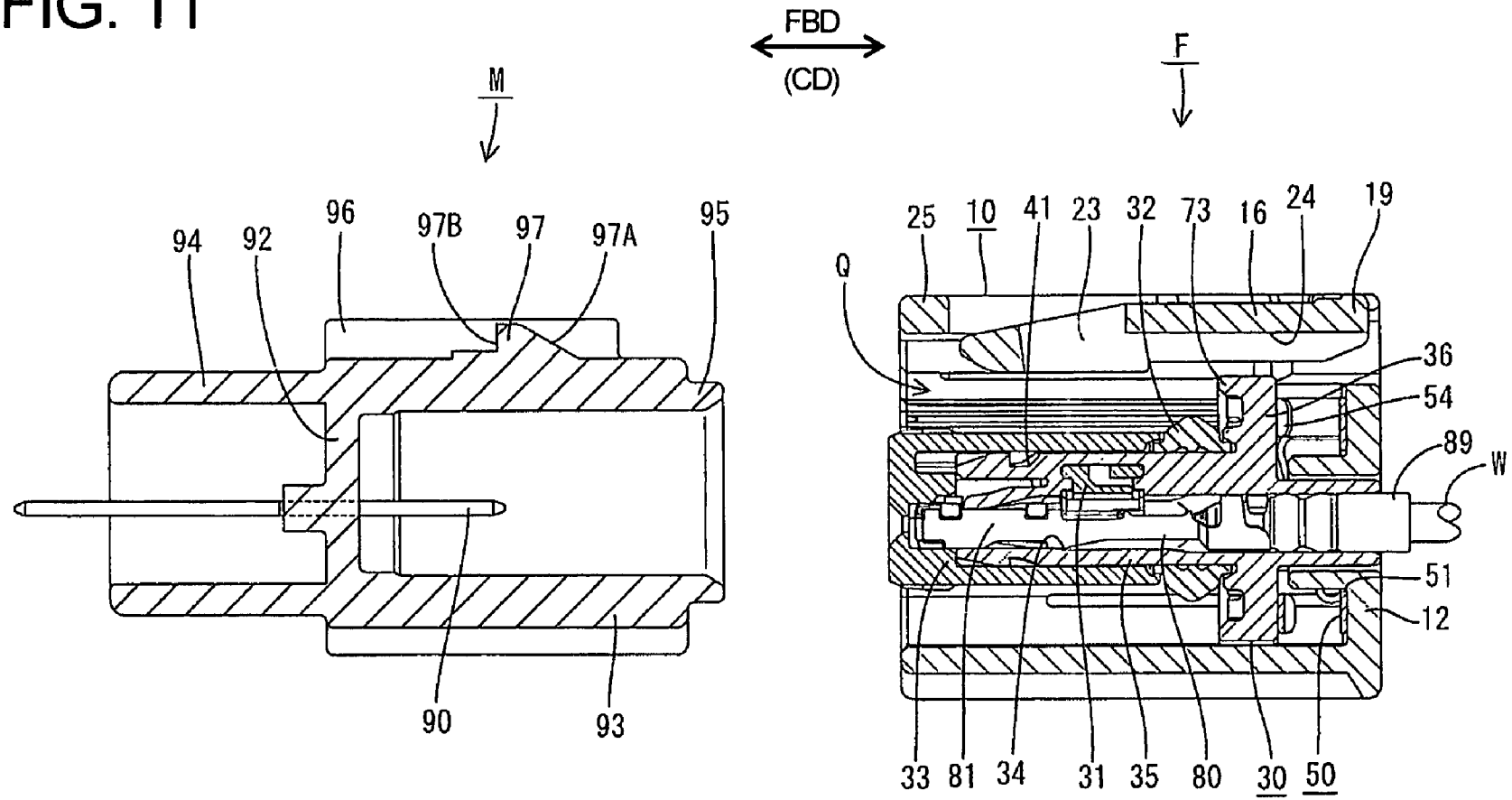
FIG. 11 is a side sectional view of the connectors before connection.

The spring 50 is a leaf spring formed by bending a metal plate that has been punched out into a specified shape. A through hole 51 extends through central part of a substantially rectangular flat portion 52 of the spring 50, as shown in FIGS. 1 and 10, and is dimensioned to loosely receive the terminal inserting portion 37 of the inner housing 30. Four strip-shaped supports 53 extend from the corners of the flat portion 52 and are folded back along corresponding side edges at the front surface of the flat portion 52. The supports 53 are arranged at substantially even intervals of about 90° about the periphery of the flat portion 52, and are bent up towards their free end. Pressing portions 54 are angled from the free ends of the bent supports 53 and utilize reaction forces of the spring 50 to press a smooth flat pressable surface 36A that extends vertically on the rear of the flange 36. Positioning projections 55 are bent back from the opposite side edges of the flat portion 52.

Figure 2:
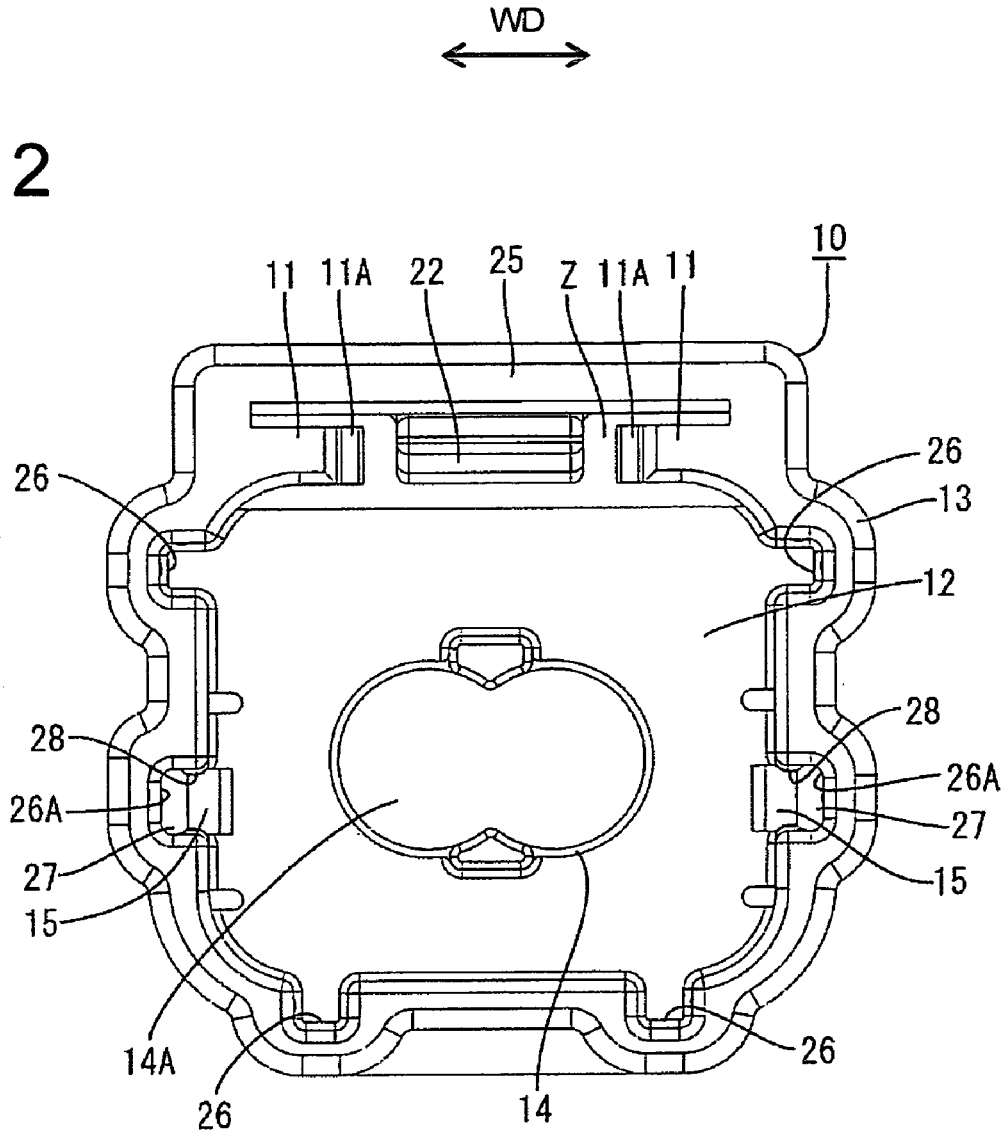
FIG. 2 is a front view of an outer housing.
Figure 3:
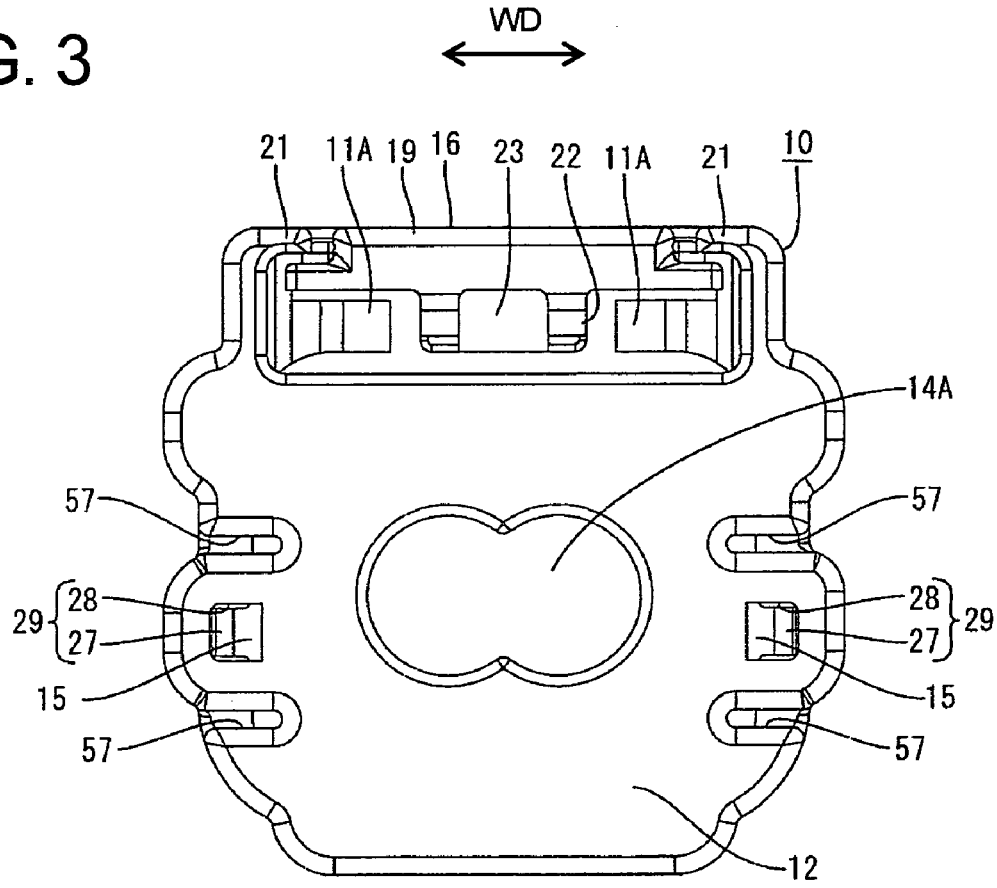
FIG. 3 is a rear view of the outer housing.
Figure 8:
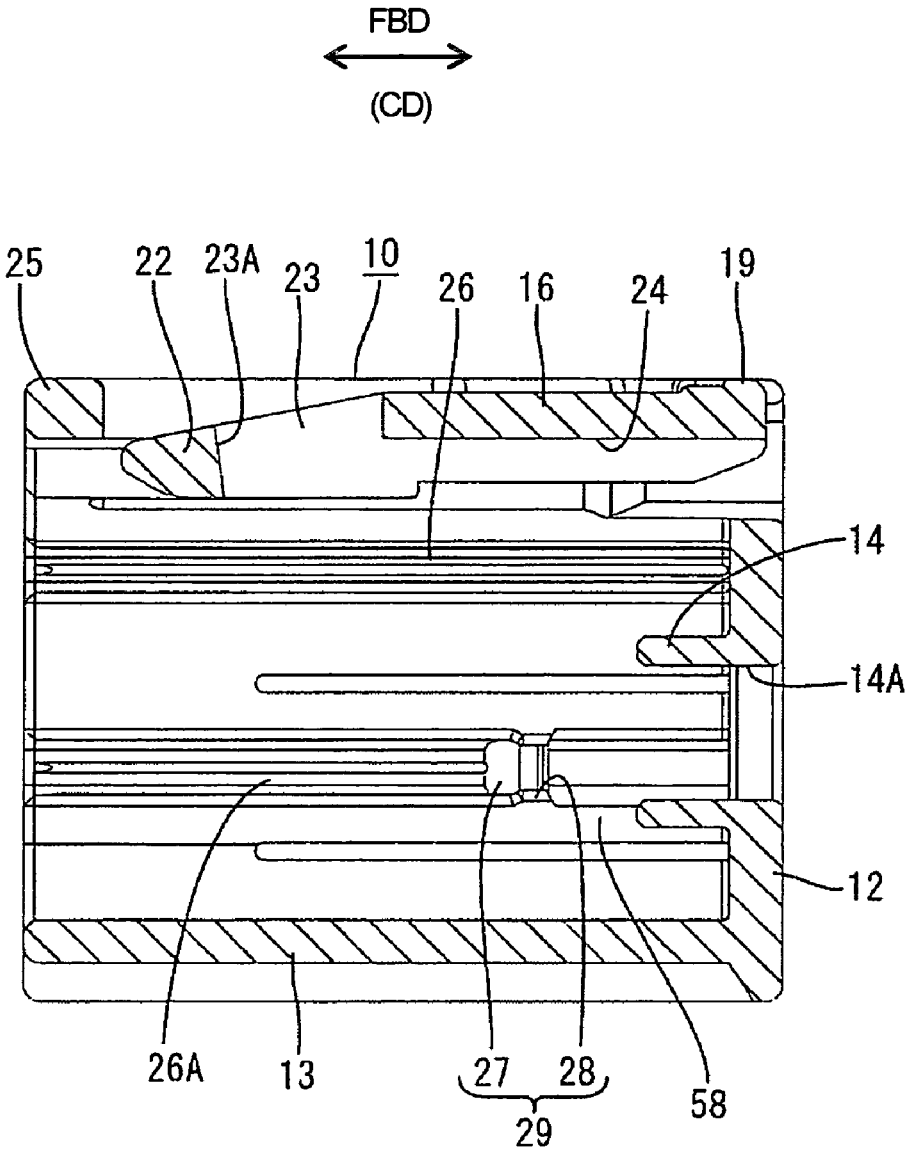
FIG. 8 is a side view in section of the outer housing.

The outer housing 10 has a back wall 12 and an outer tube 13 that projects forward from the periphery of the back wall 12, as shown in FIGS. 2, 3 and 8. The spring 50 and the inner housing 30 are inserted in this order into the outer housing 10. Thus, the spring 50 contacts the back wall 12 and the inner housing 30 is supported resiliently on the spring 50. A guiding tube 14 projects forward from the front surface of the back wall 12 at a position corresponding to the through hole 51 of the spring 50. The guiding tube 14 is formed with a loose insertion hole 14A so that the terminal inserting portion 37 of the inner housing 30 can be inserted loosely through the back wall 12. The terminal inserting portion 37 can be inserted through the through hole 51 of the spring 50 and then loosely into the loose insertion hole 14A for movement in forward and backward directions FBD in the loose insertion hole 14A. Hooking holes 15 are formed in the back wall 12 at opposite sides of the loose insertion hole 14A and receive the positioning projections 55 of the spring 50.

Figure 9:
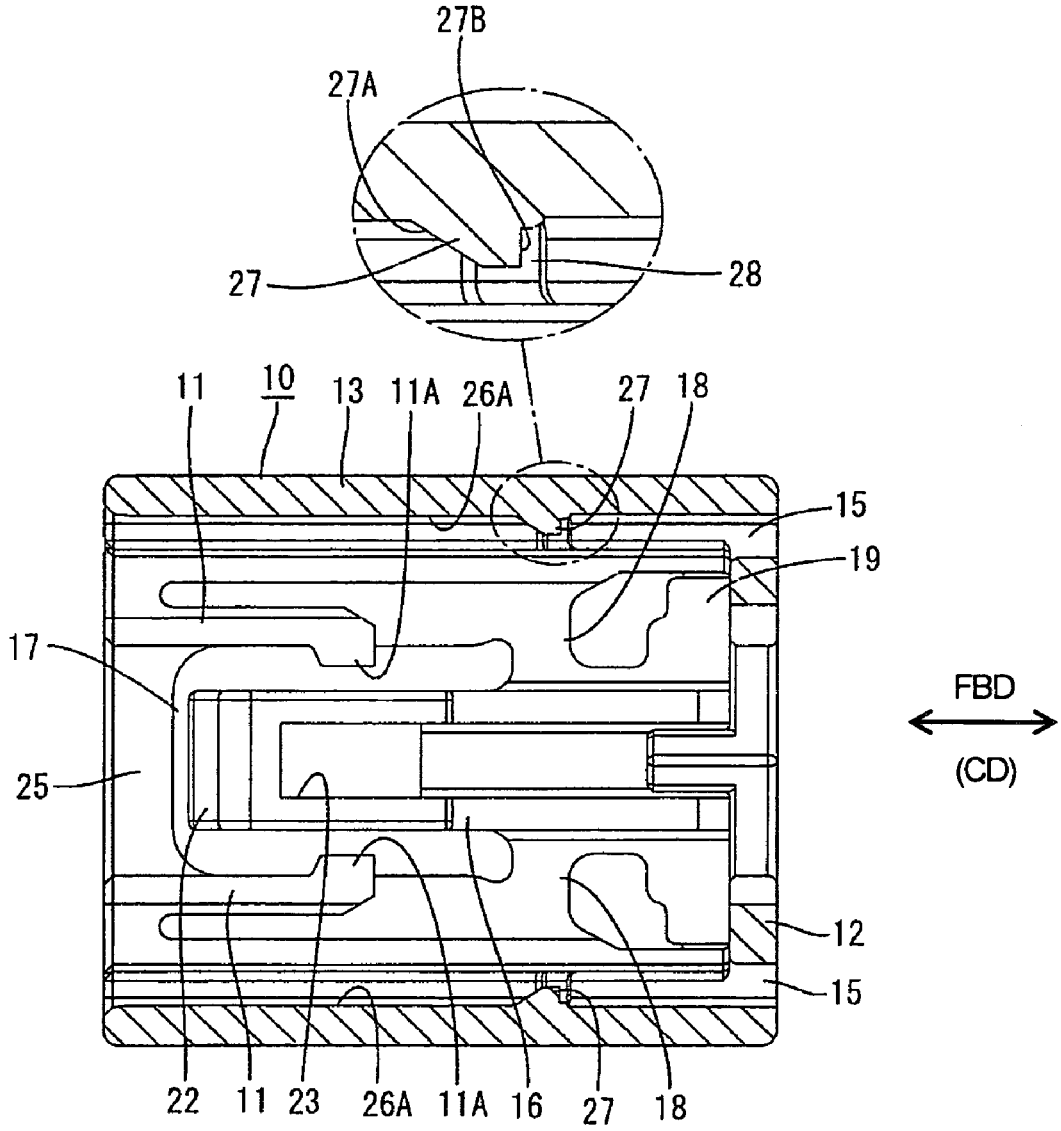
FIG. 9 is a horizontal section of the outer housing.

A lock arm 16 is provided at the upper wall of the outer tube 13 and is engageable with the interlocking portion 97 of the male connector M. The lock arm 16 is accommodated in an arm accommodating space 17 that opens in the upper wall of the outer tube 13 and the back wall 12. More specifically, the lock arm 16 is supported on the opposite side edges of the arm accommodating chamber 17 by two couplings 18, and is resiliently deformable up and down with both couplings 18 as supports, as shown in FIG. 9. A wide arm operating portion 19 is provided at the rear end of the lock arm 16 and can be operated to disengage the lock arm 16 from the interlocking position 97. Two bulges 21 are formed on the outer tube 13 and project into the arm accommodating space 17. The bulges 21 cover opposite sides of the arm operating portion 19 from above so that the lock arm 16 cannot be caught by a wire W or the like and rolled up. A lock head 22 is provided at the front end of the lock arm 16 and has an outer surface that slopes down and in toward the front in its natural state. A substantially rectangular locking hole 23 penetrates the lock head 22. An engageable surface 23A is formed at the front of the lock hole 23 and slopes up and out towards the front for strongly engaging the base end of the locking surface 97B of the interlocking portion 97. A groove 24 is formed in an area of the lower surface of the lock arm 16 behind the locking hole 23. The groove 24 extends in forward and backward directions FBD and makes an opening in the rear surface.

A bridge 25 is provided at the upper wall of the outer tube 13 and crosses a front area of the arm accommodating space 17 in the width direction WD. The front end of the lock head 22 is below the bridge 25 and can be seen through an insertion space Z of the outer tube 13 when viewed from front.

Two resistance arms 11 are provided below the opposite lateral edges of the accommodating chamber 17 in the outer tube 13 and extend back from the front end of the outer tube 13. The resistance arms 11 are substantially parallel to and spaced slightly from the upper wall of the outer tube 13 and are resiliently deformable in the width direction WD. Contacts 11A are provided at the leading ends of the resistance arms 11 and face the arm accommodating space 17. The front ends of the guide ribs 96 on the upper surface of the surrounding wall of the receptacle 93 engage the contacts 11A and deform the resistance arms 11 out against their own resilient forces. A large connecting force is required to resiliently deform the resistance arms 11. The connecting operation then proceeds at a stroke by the action of an inertial locking mechanism for creating a large connection resistance, thereby avoiding a situation where the two connectors F, M are left partly connected.

Guide grooves 26 extend in forward and backward directions FBD on the outer tube 13 at positions corresponding to the guide ribs 96 on the receptacle 93 of the male connector M, and at positions corresponding to the guide ribs 77 and the latches 78 on the flange 36 of the inner housing 30. The guide ribs 96, 77 and the latches 78 can be inserted in and guided along the guide grooves 26. The guide grooves 26 that correspond to the two guide ribs 96 on the upper surface of the surrounding wall of the receptacle 93 are formed by the insertion space Z between the inner side surfaces of the resistance arms 11, and both guide ribs 96 and the interlocking portion 97 are insertable into the insertion space Z.

The guide grooves 26 that correspond to the lower guide ribs 96 on the opposite side surfaces of the surrounding wall of the receptacle 93 and the latches 78 on the flange 36 of the inner housing 30 are referred to herein as main guide grooves 26A and communicate with the hooking holes 15 in the back wall 12. A main receiving portion 27 projects in at an intermediate position of each main groove 26A with respect to forward and backward directions FBD so that the main receiving portions 29 face each other in the width direction WD. A guidable surface 27A slopes in and back on the front of each main receiving portion 27 and can be held substantially in sliding contact with the guiding surface 78B of the corresponding latch 78. An interlocking surface 27B extends normal to the forward and backward directions FBD at the rear of each main receiving portion 27 and can be brought into surface contact with the locking surface 78A of the latch 78. The projecting height of the main receiving portions 27 is shorter than the depth of the main guide grooves 26A, and a vertical dimension of the main receiving portions 27 is less than the vertical dimension of the bottom surfaces of the main guide grooves 26A.

A loose movement preventing portion 28 is formed in each main guide groove 26A at a position behind the respective main receiving portion 27. Each loose movement preventing portion 28 is a substantially U-shape protrusion formed on the surfaces of the main groove 26*a* in a position to substantially surround three sides of the rear end of the main receiving portion 27. The loose movement preventing portion 28 extends over substantially the entire height and width of the main guide groove 26A. Thus, the loose movement preventing portion 28 narrows the groove width. The main receiving portion 27 and the loose movement preventing portion 28 in each main guide groove 26A define a receiving portion 29. The latch 78 that engages the main receiving portion 27 is fit closely into the loose movement preventing portion 28. Thus, loose movements of the latch 78 are prevented with respect to the height direction and the width direction WD. More specifically, the length of the loose movement preventing portion 28 from the rear end of the main receiving portion 27 in forward and backward directions FBD is less than a moving amount of the inner housing 30 that moves as the two connectors F, M are connected. The latches 78 disengage from the loose movement preventing portions 28 when the two connectors F, M are connected properly to cancel the loose movement prevented state.

Slits 57 are formed in the outer tube 13 above and below each main guide groove 26A. The slits 57 extend in forward and backward directions FBD and making openings in the back wall 12. A resilient piece 58 that includes the main guide groove 26A is formed between each pair of upper and lower slits 57, and is resiliently deformable along the width direction WD with the front end of the outer tube 13 as a base. The resilient pieces 58 deform to widen the spacing therebetween when the latches 78 reach the guidable surfaces 27A of the main receiving portions 27, thereby permitting the latches 78 to move over the main receiving portions 27. The resilient pieces 58 restore resiliently when the connectors F, M are connected properly so that the locking surfaces 78A of the latches 78 and the interlocking surfaces 27B of the main receiving portions 27 face each other in disengaging directions. As a result, the latches 78 are engaged with the receiving portions 29.

The female connector F is assembled by mounting the seal 32 and the front member on the main portion 35 of the inner housing 30 from the front. The retainer 31 also is inserted sideways into the mount hole 42 of the main portion 35 to be held at the partial locking position. The female terminal fittings 80 crimped into connection with the ends of the wire W then are passed successively through the loose insertion hole 14A of the outer housing 10 and the through hole 51 of the spring 50 and further are inserted into the terminal accommodating chamber 34 of the inner housing 30 from behind. A resilient or rubber plug 89 on the end of each wire W is brought into close sealing contact with the inner circumferential surface of the terminal accommodating chamber 34. The retainer 31 then is pushed to the full locking position so that the female terminal fittings 80 are locked doubly by the locks 38 and the retainer 31.

The spring 50 is inserted into the outer housing 10 from the front. Thus, the guiding tube 14 on the back wall 12 passes through the through hole 51 of the spring 50, and the positioning projections 55 of the spring member 50 enter the hooking holes 15 of the back wall 12 and are hooked. Thus, the spring 50 is held in contact with the back wall 12 of the outer housing 10. The inner housing 30 then is inserted from the front to bring the pressable surface 36A of the inner housing 30 resiliently into contact with the pressing portions 54 of the supports 53 of the spring 50. Upon inserting the inner housing 30, the latches 78 of the flange 36 enter the main guide grooves 26A of the outer housing 10 from the front and the inner housing 30 is pushed farther to the back so that the latches 78 move resiliently over the main receiving portions 27.

Figure 16:
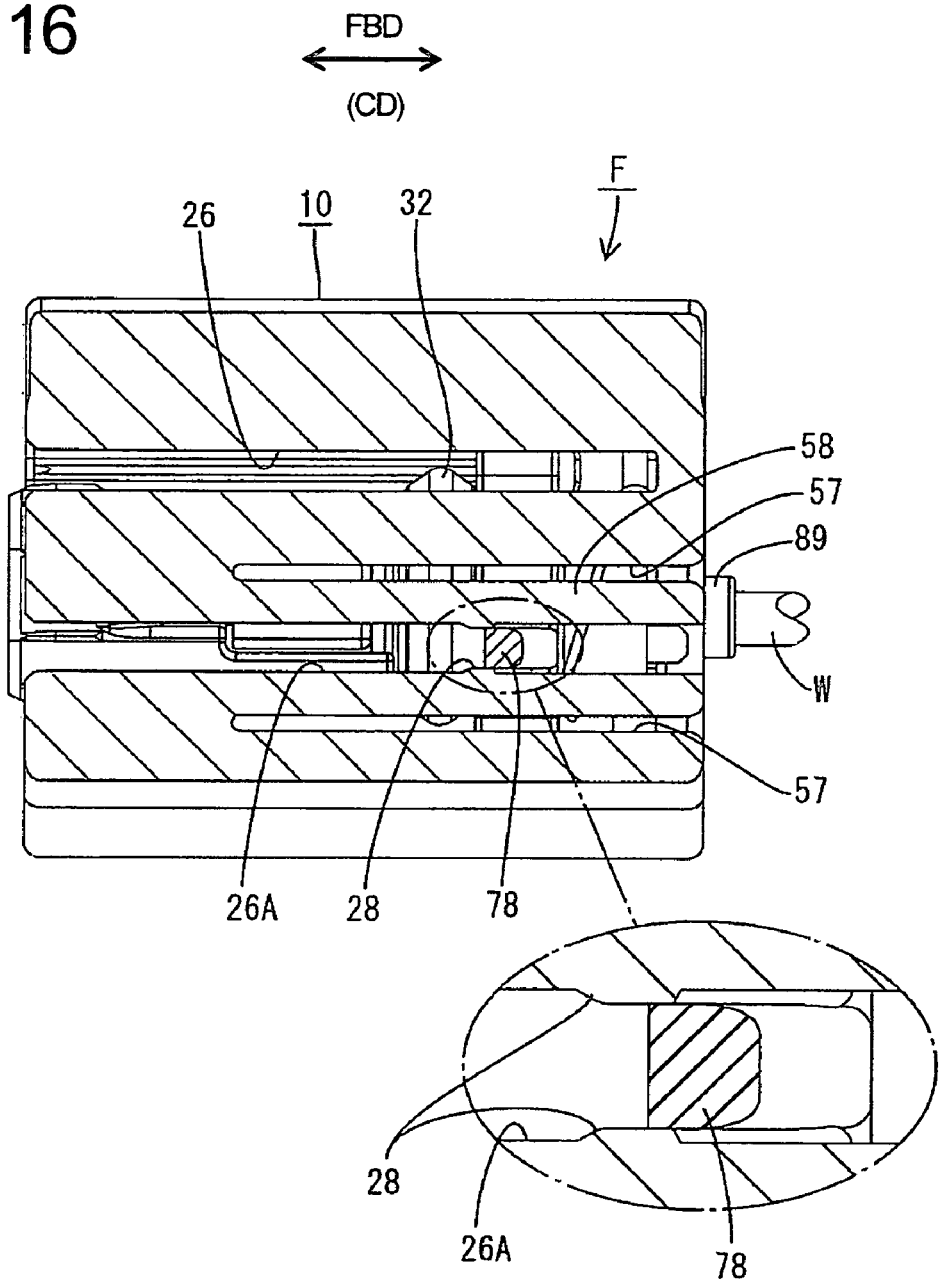
FIG. 16 is a side view in section of the female connector showing a state where latching portions and receiving portions are engaged.

The latches 78 are locked by the main receiving portions 27 when the inner housing 30 reaches a proper insertion position. The latches 78 are surrounded by the loose movement preventing portions 28, as shown in FIGS. 14 and 16, to have loose movements prevented. Further, the supports 53 of the spring 50 are compressed resiliently a small amount between the pressable surface 36A of the inner housing 30 and the front surface of the back wall 12. The rear end of the terminal inserting portion 37 is substantially flush with the rear surface of the back wall 12 of the outer housing 10 when the inner housing 30 reaches the proper insertion position, and the front end of the front member 33 projects slightly more forward than the front opening of the outer housing 10.

The male connector M is fit from the front into the outer housing 10 after the components of the female connector F are assembled. Thus, the guide ribs 96 of the receptacle 93 enter the corresponding guide grooves 26 of the outer housing 10. The surrounding wall of the receptacle 93 is inserted into the connection space Q of the outer housing 10, and the receptacle 93 is pushed to the back. The pushing portion 95 of the receptacle 93 then enters the recess 74 at the inner side of the deformation preventing portion 73 and is pushed against the front surface of the flange 36. The flange 36 is pushed back by the pushing portion 95 as the male connector M is fit further. As a result the latches 78 are separated from the main receiving portions 27.

Figure 15:
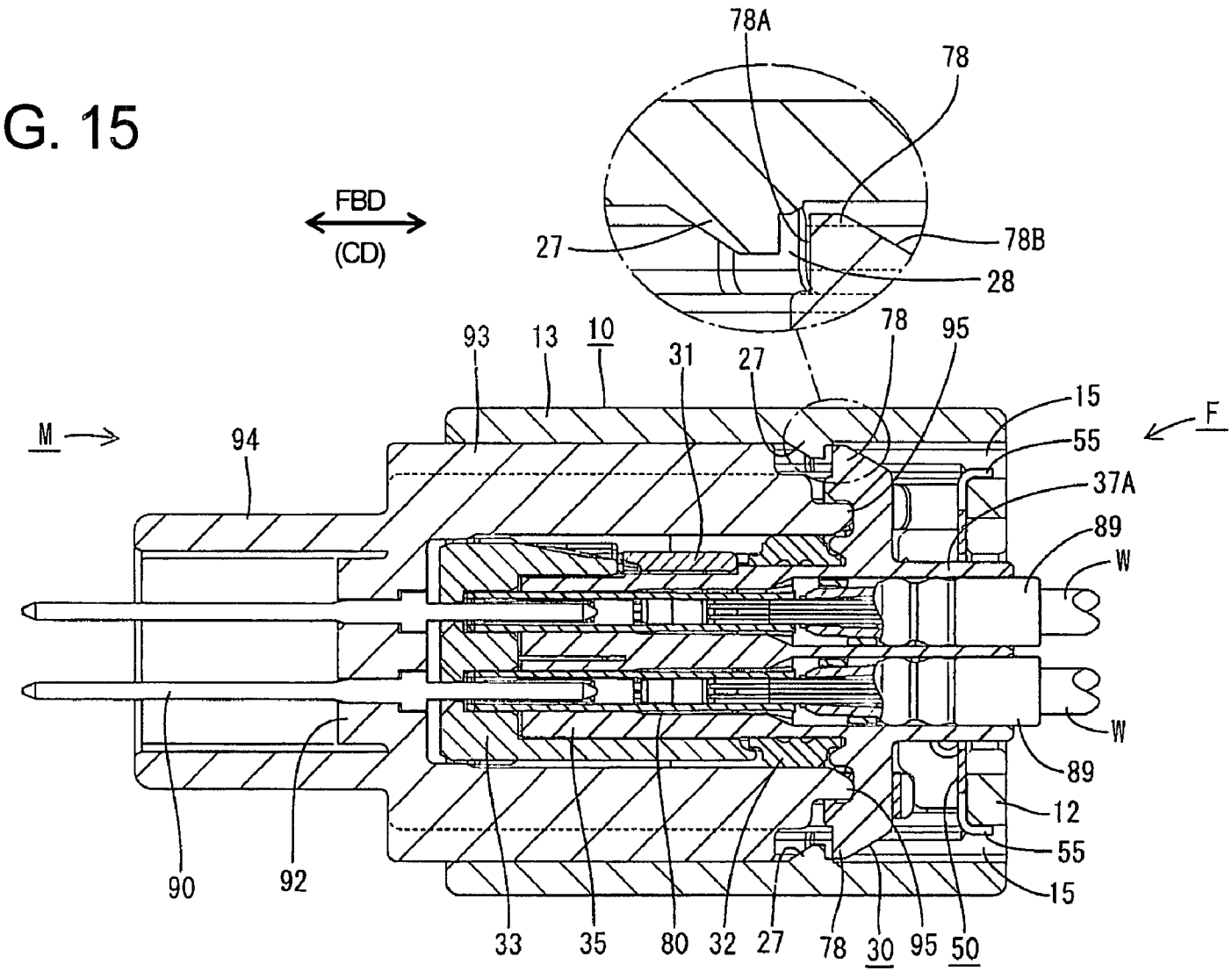
FIG. 15 is a horizontal section of the properly connected connectors.
Figure 17:
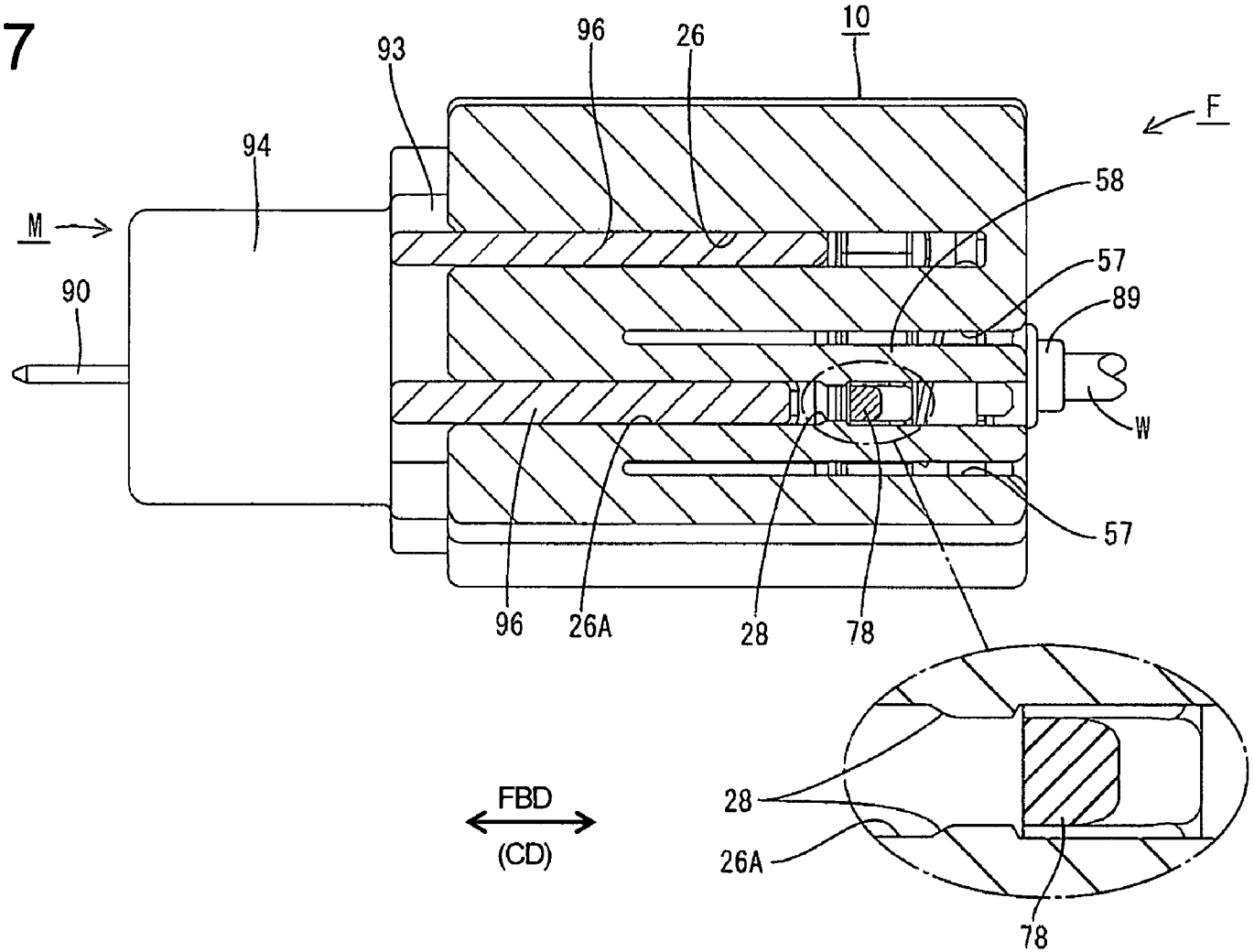
FIG. 17 is a side view in section of the female connector showing a state where the latching portions and the receiving portions are separated.
Figure 18:
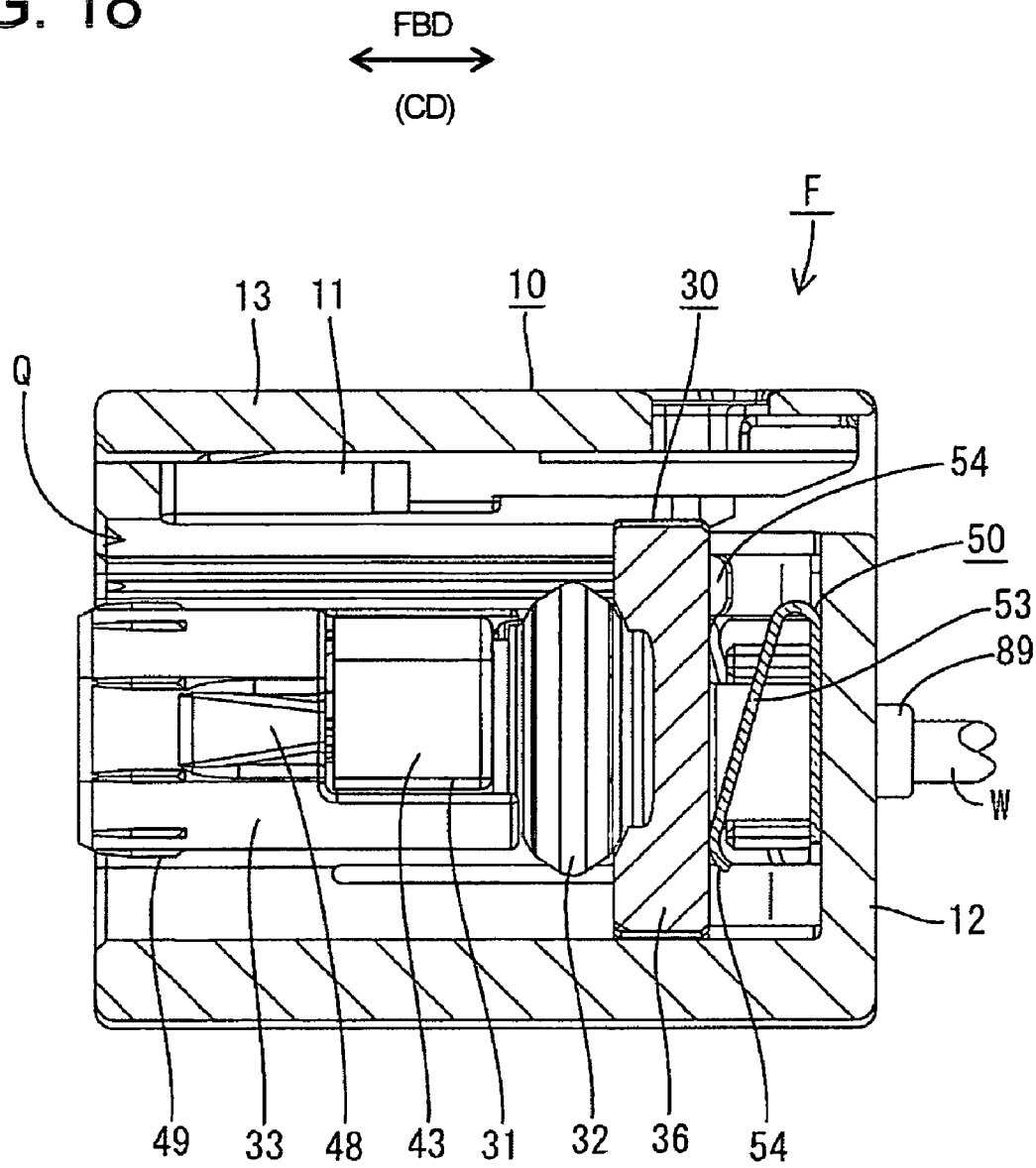
FIG. 18 is a side view in section of the female connector showing a state where the inner housing and the like are assembled.
Figure 19:
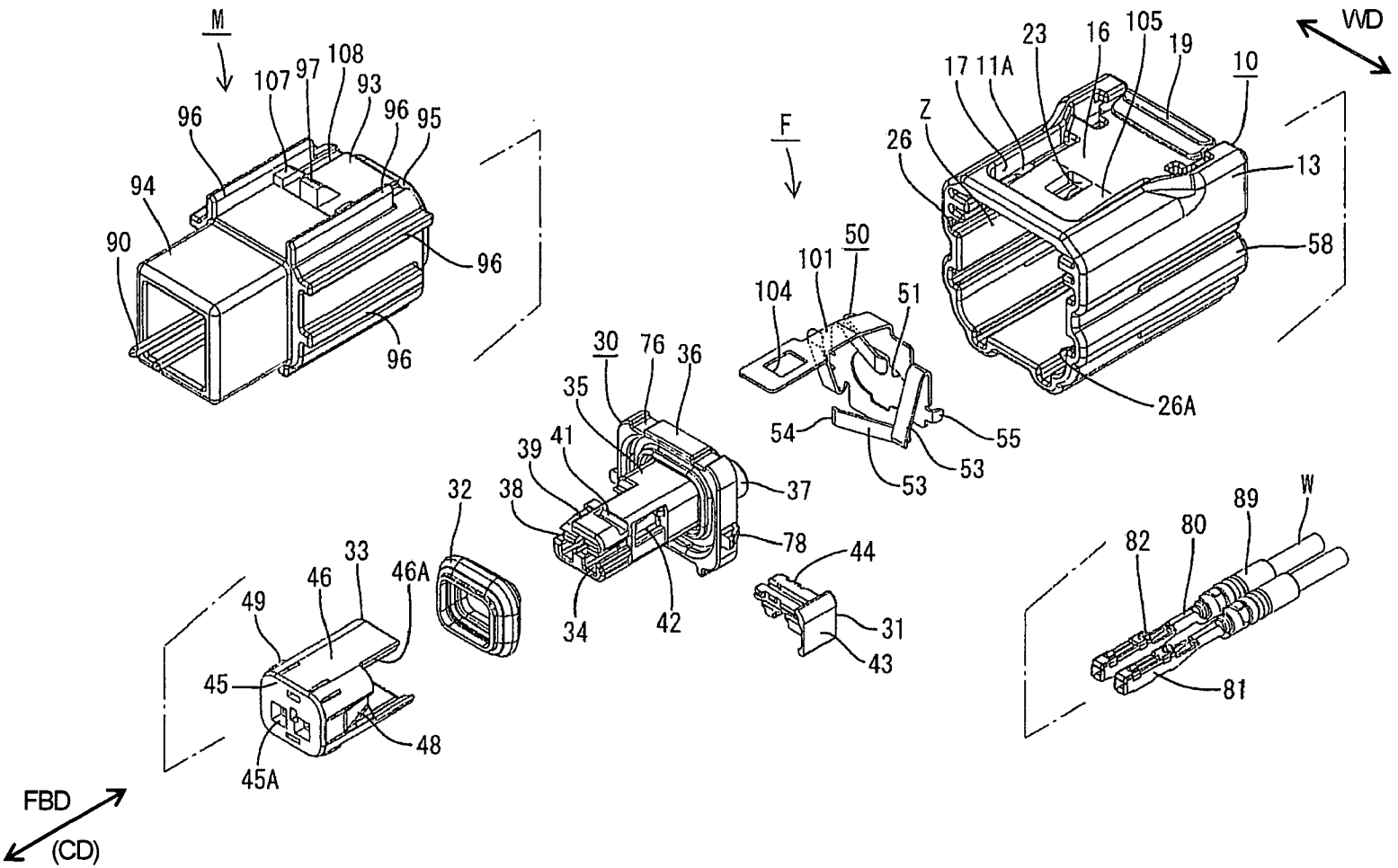
FIG. 19 is an exploded perspective view of male and female connectors according to a second embodiment.

The latches 78 slide on the loose movement preventing portions 28 as the male connector M is fit farther in, and the inner housing 30 is moved and guided along the same axis. The latches 78 separate from the loose movement preventing portions 28 when the two connectors F, M are connected properly and push the inner housing 30 to a loose movement permitting space defined at the rear of the outer housing 10, as shown in FIGS. 15 and 17.

Figure 12:
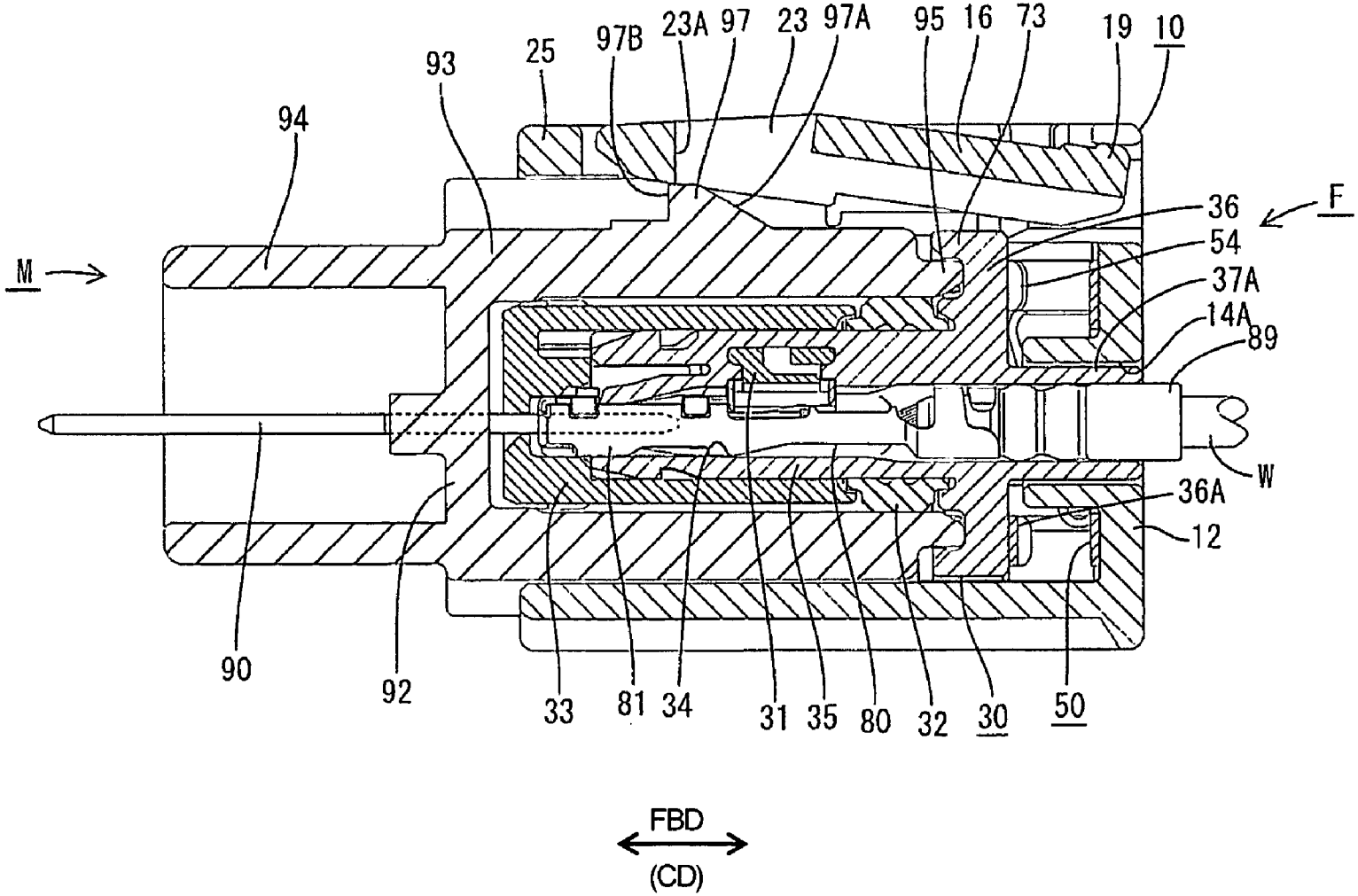
FIG. 12 is a side sectional view of the connectors being connected.
Figure 13:
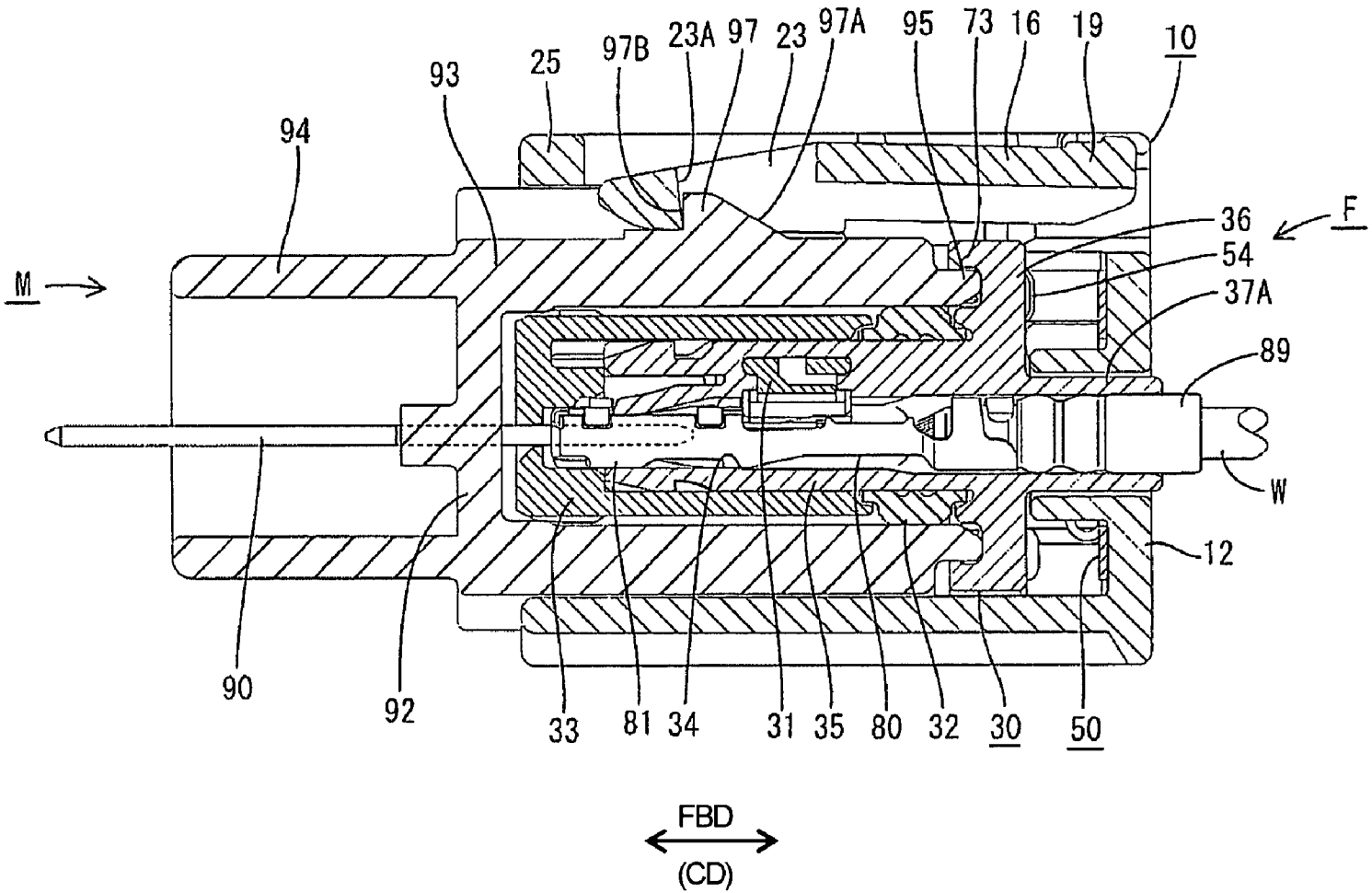
FIG. 13 is a side sectional view of the connected connectors.

The lock arm 16 of the outer housing 10 moves resiliently onto the guiding surface 97A of the interlocking portion 97 when the pushing portion 95 of the receptacle 93 is pushed against the front surface of the flange 36, as shown in FIG. 12. The lock arm 16 engages the interlocking portion 97 when the connectors F, M reach the properly connected position shown in FIG. 13, thereby holding the connectors F, M together. The inner housing 30 is pushed to the loose movement permitting space, as described above, when the two connectors F, M are connected properly, and is supported floatingly between the back wall 12 of the outer housing 10 and the male connector M via the spring 50 for movement in connecting directions CD. The supports 53 of the spring 50 are compressed resiliently and press the pressable surface 36A of the inner housing 30. The surrounding wall of the receptacle 93 is squeezed in the thickness direction between the deformation preventing portion 73 of the flange 36 and the outer peripheral surface of the seal 32, and is held strongly on the inner housing 30 by the biting projections 75 of the deformation preventing portion 73 and the protrusions 49 of the front member 33. In this way, the male connector M and the inner housing 30 act as an integral unit.

The male connector M is coupled directly to the apparatus and hence vibrates if the apparatus vibrates. However, the spring 50 supports the inner housing 30 floatingly between the male connector M and the outer housing 10. Therefore, the inner housing 30 displaces while following the movement of the male connector M, and there is substantially no likelihood of shaking between the inner housing 30 and the male connector M. Accordingly, the vibration timings of the male terminal fittings 90 in the male connector M and the female terminal fittings 80 in the inner housing 30 are synchronized, and the vibration will not abrade the female and male terminal fittings 80, 90.

As described above, the inner housing 30 is supported floatingly to follow the movements of the male connector M, thereby suppressing vibration related abrasion of the terminal fittings 80, 90. Therefore, contact reliability between the terminal fittings 80 and 90 can be ensured.

The loose movement preventing portions 28 prevent loose movements of the latches 78 of the inner housing 30 so that the latches 78 rigidly engage the interlocking portions 29 of the outer housing 10 before the connection with the male connector M. Thus, the inner housing 30 cannot shake prior to connection and the connection position with the male connector M can be determined precisely. The latches 78 and the loose movement preventing portions 28 slide on each other to guide the movement of the inner housing 30 during connection with the male connector M. Thus, the inner housing 30 and the male connector M are held substantially coaxial. The latches 78 separate from the loose movement preventing portions 28 of the receiving portions 29 and are freed from the rigidly engaged state when the male connector M is connected properly, and the inner housing 30 is moved to the loose movement permitting space in the outer housing 10. Thus, the inner housing 30 will smoothly follow the movements of the male connector M.

The spring 50 has the four equally spaced supports 53 at substantially even intervals (90°). The supports 53 resiliently support and press the pressable surface 36A of the inner housing 30 towards the male connector M. Thus, the resilient forces of the supporting portions 53 substantially equally act over the entire periphery of the inner housing 30, thereby preventing a displacement of the central axis of the inner housing 30.

The deformation preventing portion 73 presses the surrounding wall of the receptacle 93 to prevent the resilient force of the seal 32 from causing a widening deformation. Thus, vibrations will not shake the receptacle 93 after the connection of the two connectors F, M. As a result, the sealing property of the seal 32 will not be reduced.

A second embodiment of the invention is illustrated in FIGS. 19 to 35. The second embodiment differs from the first embodiment in the locking construction for the female and male connectors F, M. However, the inner housing 30, the retainer 31, the seal 32 and the front member 33 have substantially the same constructions as those of the first embodiment and are not described again.

The outer housing 10 is made e.g. of a polybutylene terephthalate resin (PBT), and preferably has no reinforcing material, such as glass fibers, to ensure good deflectability of the lock arm 16. On the other hand, the receptacle 93 of the male connector M preferably contains a reinforcing material, such as glass fibers, and therefore is harder than the outer housing 10. Accordingly, resilient forces of the spring 50 in a separating direction of the connectors F, M may cause the lock arm 16 to deform due to creep of the resin. Thus, a reinforcing plate 101 is inserted in the lock arm 16 to cover at least part of a surface that contacts the interlocking portion 97 for preventing resin creep.

Figure 20:
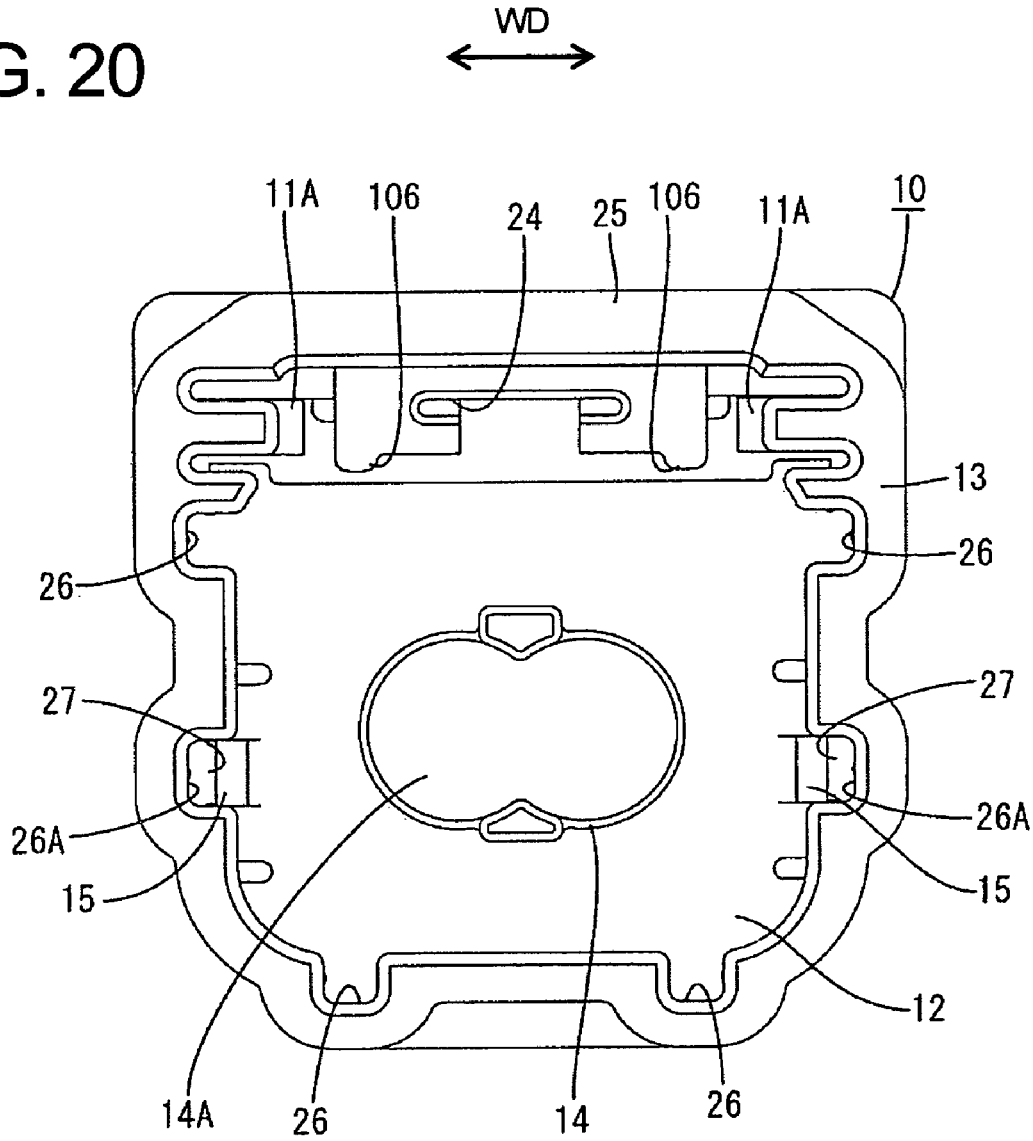
FIG. 20 is a front view of an outer housing.
Figure 22:
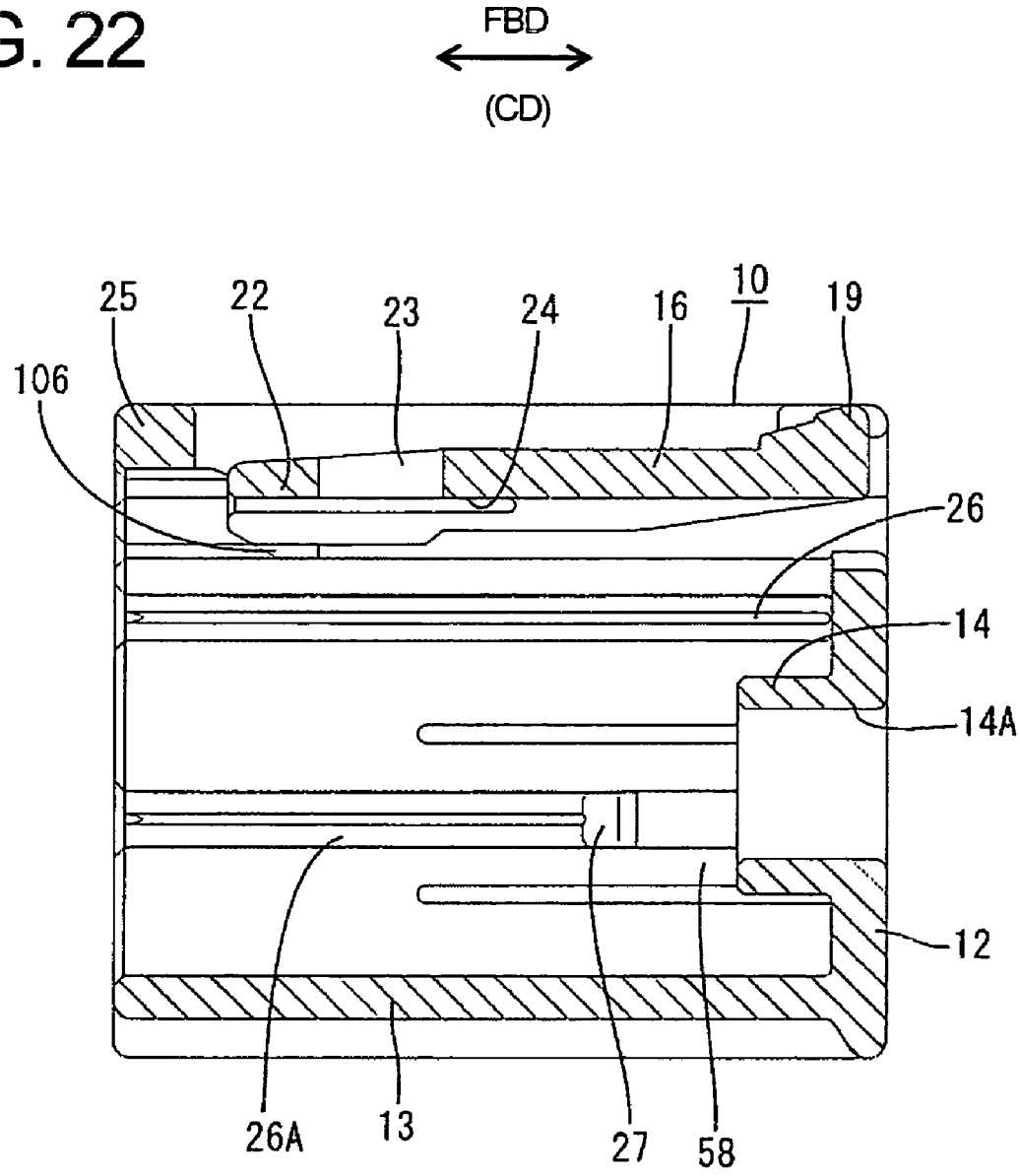
FIG. 22 is a side view in section of an outer housing.
Figure 23:
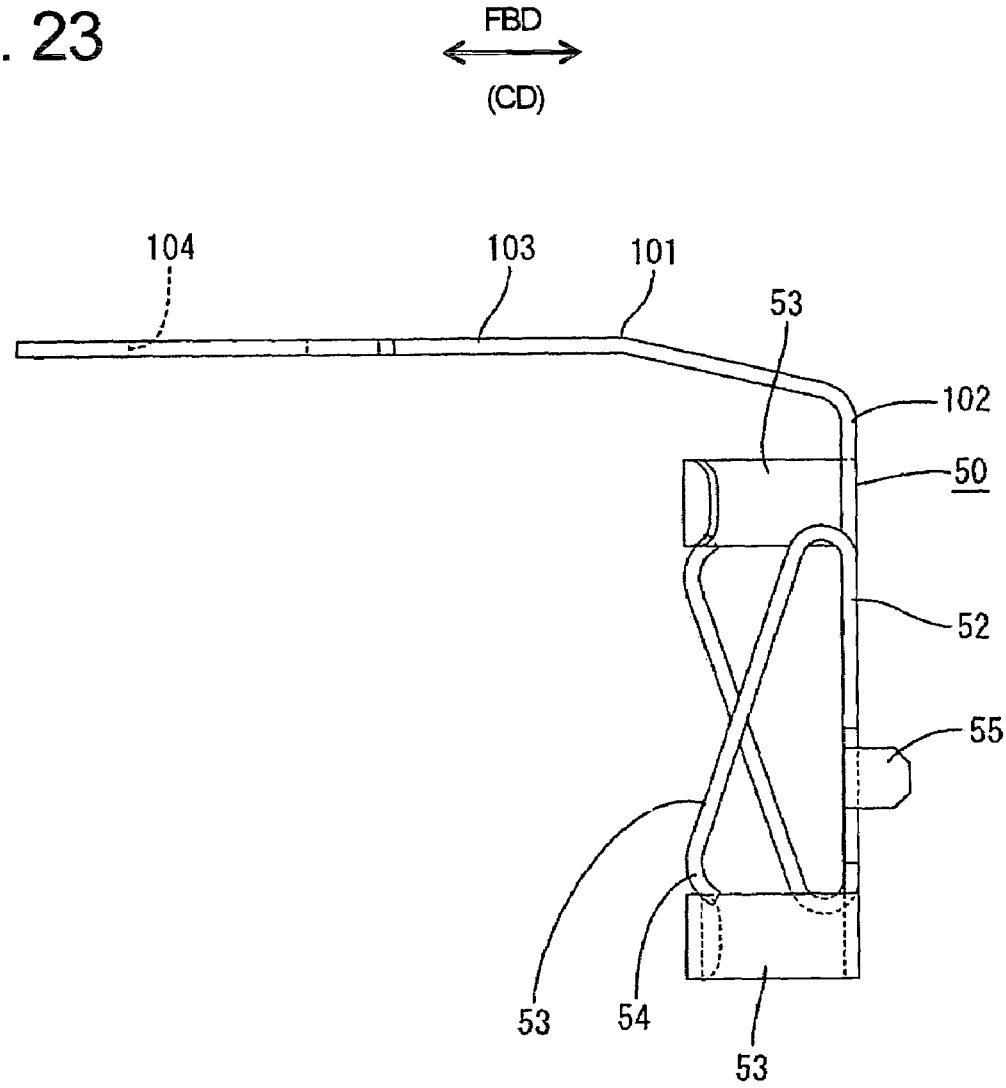
FIG. 23 is a side view of a spring member.
Figure 24A:
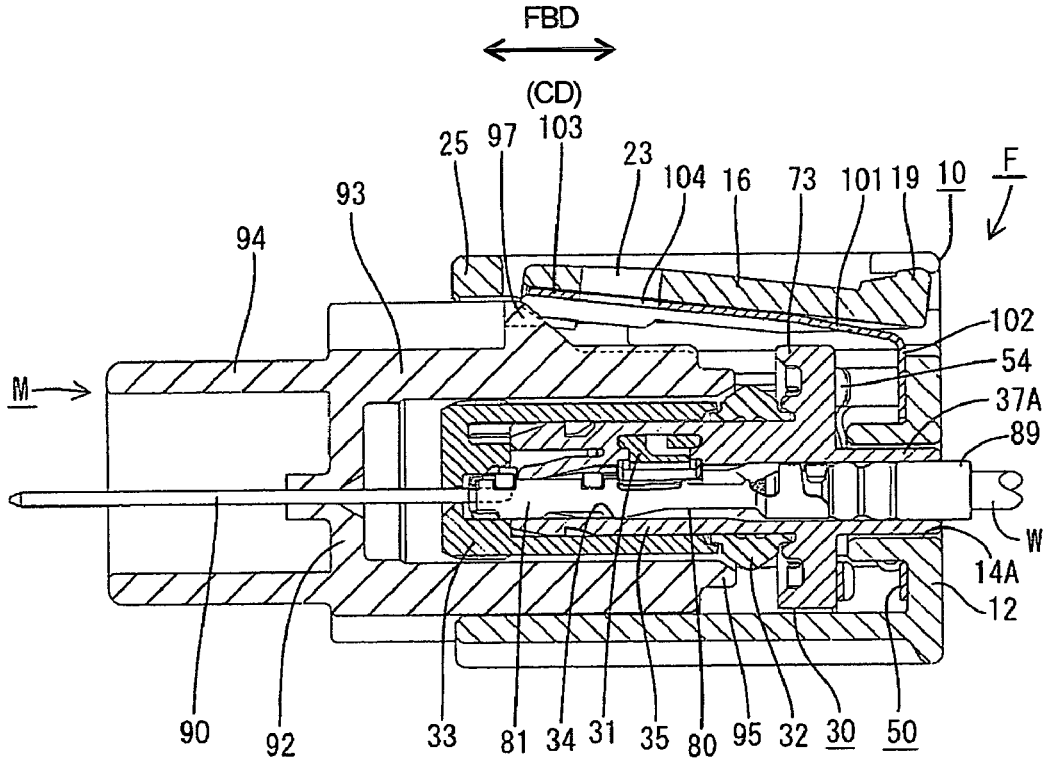
FIG. 24A is a side view in section of the two connectors when a lock arm is lifted up during a connecting operation.

The reinforcing plate 101 is formed unitarily with the spring 50 and includes a base 102 that extends from a substantially middle part of the upper edge of the substantially flat portion 52 to be arranged along the front surface of the back wall 12 of the outer housing 10. An extension 103 extends forward from the upper end of the base 102 and is arranged along the inner surface of the lock arm 16, as shown in FIGS. 23 and 24A. A groove 24 is formed in the lower surface of the lock arm 16 and extends substantially in forward and backward directions FBD. The groove 24 opens in both front and rear surfaces of the lock arm 16 as shown in FIGS. 20 and 22, and the front part of the extension 103 is formed with a substantially rectangular window 104 that communicates with the locking hole 23 of the lock arm 16. The extension 103 of the reinforcing plate 101 is fit in the groove 24.

Figure 21:
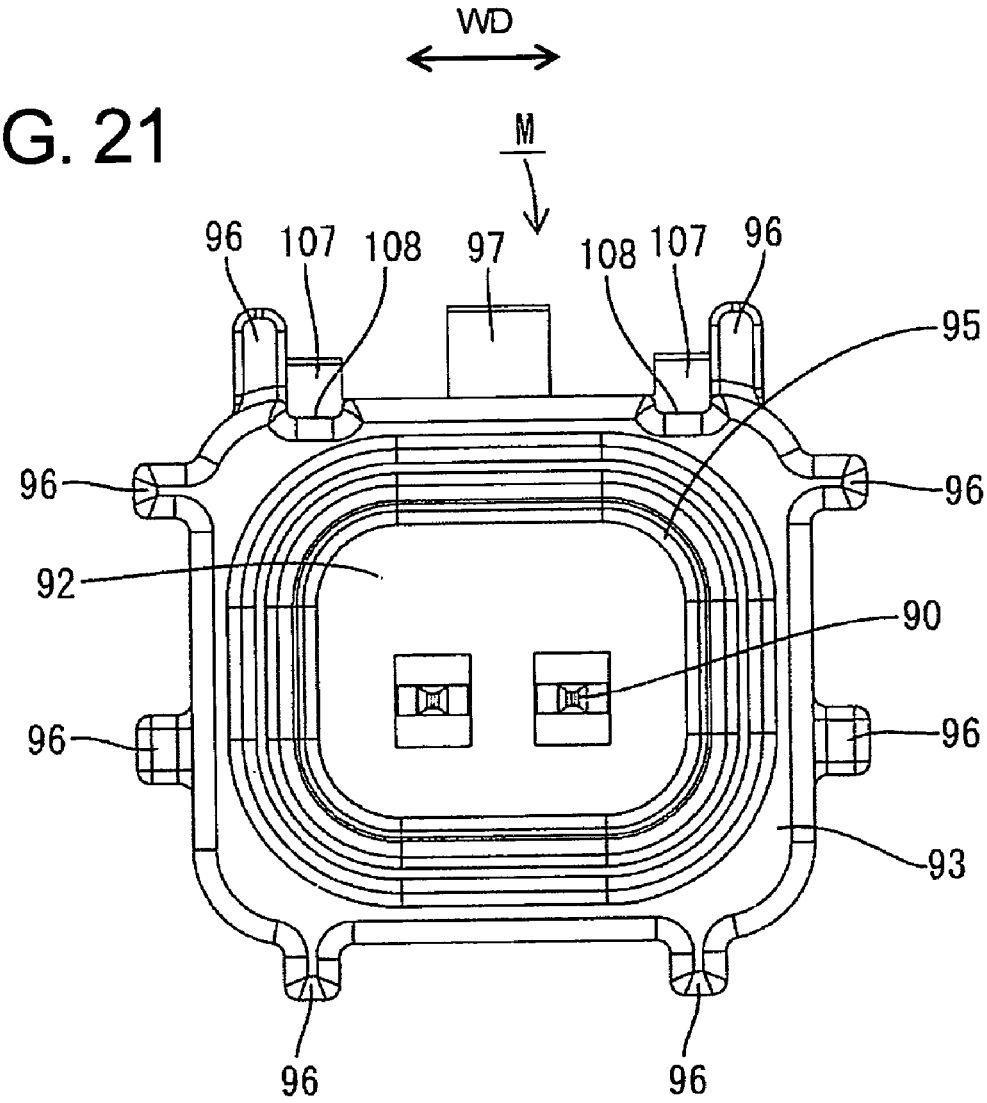
FIG. 21 is a front view of the male connector.
Figure 28:
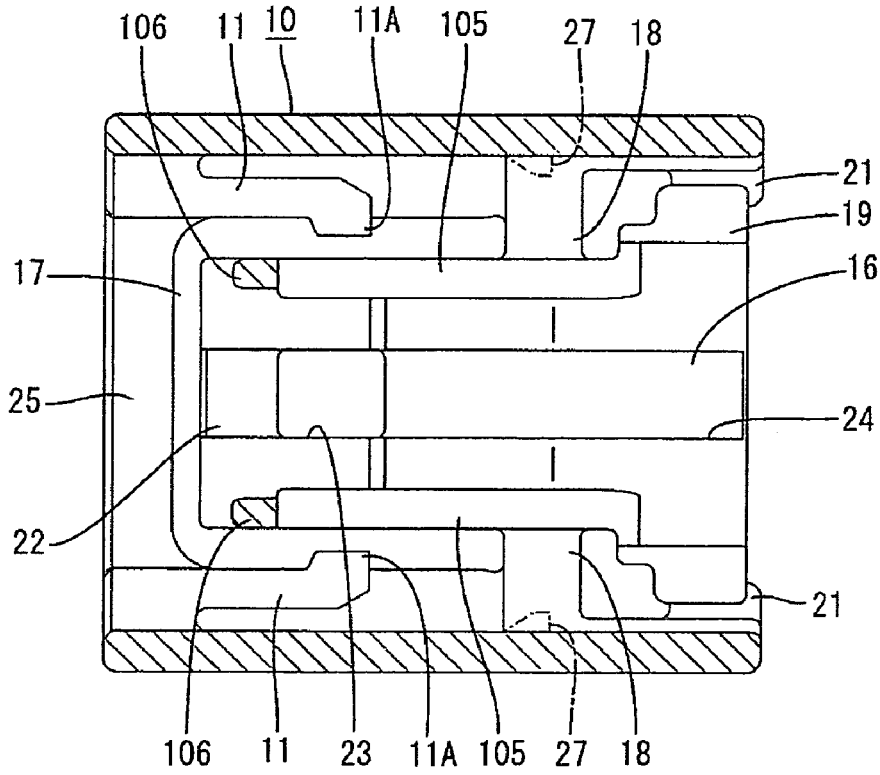
FIG. 28 is a horizontal section of the outer housing.

The female connector F of the second embodiment also has protecting means for preventing the interlocking portion 97 from being abraded by the metallic reinforcing plate 101 sliding on the interlocking portion 97 in the process of connecting the two connectors F, M. Specifically, widened portions 105 extend laterally out in the width direction WD from the opposite lateral edges of the lock arm 16 and lifting portions 106 are provided at the widened portions 105, as shown in FIG. 28. The lifting portions 106 lift the lock arm 16 to avoid interference with the interlocking portion 97 in the process of connecting the two connectors F, M. Two interacting portions 107 project from the upper surface of the receptacle 93 of the mating male connectors M at the opposite sides of the interlocking portion 97, as shown in FIG. 21, for engaging the lifting portions 106.

An upwardly and rearwardly sloped guiding surface 107A is formed at the front surface of each interacting portion 107, and the front end thereof substantially aligns with the front end of the guiding surface 97A of the interlocking portion 97. Further, outer sides of the lifting portions 107 are connected unitarily with the guide ribs 96. The upper ends of the interacting portions 107 are lower than the upper ends of the guide ribs 96 and the interlocking portion 97. Lifting-portion guiding grooves 108 are formed in the upper surface of the receptacle 93 before and adjacent to the interacting portions 107 and extend up to the front surface of the receptacle 93.

The lifting portions 106 project down and in at the front ends of the widened portions 105. The widened portions 105 are thinned in areas behind the lifting portions 106 and are thinner than the lock arm 16. The front surfaces of the lifting portions 106 slope down and in towards the back and can slide smoothly in contact with the guiding surfaces 107A of the interacting portions 107. The rear ends of the lifting portions 106 align with the front end of the locking hole 23. The lifting portions 106 move along the lifting-portion guiding grooves 108 to move smoothly onto the guiding surfaces 107A of the interacting portions 107.

The second embodiment is similar to the first embodiment in that the inner housing 30 is supported floatingly between the male connector M and the outer housing 10 via the spring 50. Thus, this structure is not described. A locking action by the lock arm 16 is described in detail below.

Figure 24B:
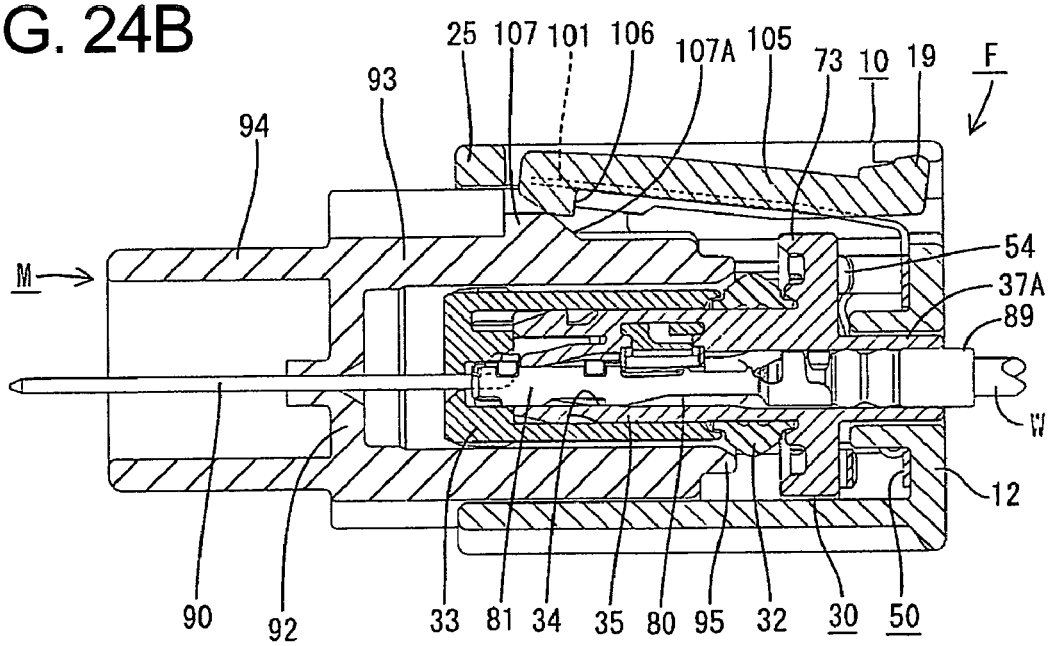
FIG. 24B is a side view in section of the two connectors when lifting portions move onto interacting portions during the connecting operation.
Figure 27:
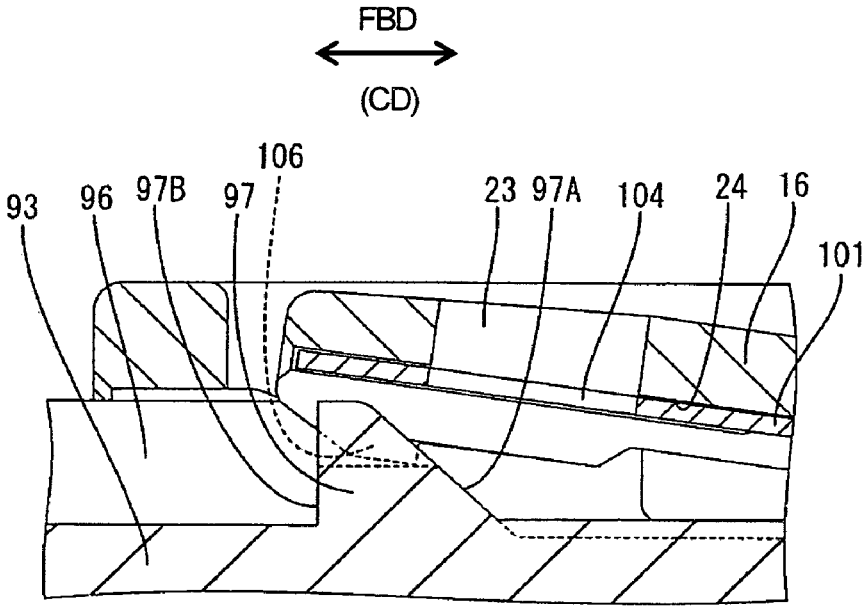
FIG. 27 is a side view in section showing a state where the lock arm is lifted to such a position as not to interfere with the interlocking portion.

The connecting operation of the female and male connectors F, M starts by positioning the two connectors F, M in opposed relationship so that the connecting surfaces thereof face each other. The lifting portions 106 move onto the guiding surfaces 107A of the interacting portions 107 after a while following the start of the connecting portion and lift the lock arm 106, as shown in FIG. 24B. The lock arm 16 has reached a position corresponding to the interlocking portion 97 in the state shown in FIG. 24A, but is above the guiding surface 97A of the interlocking portion 97 and hence does not contact the interlocking portion 97. The lifting portions 106 reach positions where move over the interacting portions 107 as the connecting operation proceeds, as shown in FIG. 24B. The lock arm 16 also reaches a position where it can move over the interlocking portion 97 as shown in FIGS. 24A and 27, but does not interfere with the interlocking portion 97.

The components of the female connector F are assembled as described above with reference to the first embodiment. The male connector M then is inserted into the outer housing 10 from the front. As a result, the guide ribs 96 of the receptacle 93 fit into the corresponding guide grooves 26 of the outer housing 10, while the surrounding wall of the receptacle 93 is inserted into the connection space Q of the outer housing 10. The receptacle 93 is pushed to the back in this state. Thus, the pushing portion 95 of the receptacle 93 enters the recess 74 the inner side of the deformation preventing portion 73 and is pushed against the front surface of the flange 36. The flange 36 is pushed by the pushing portion 95 and is moved back as the male connector M is inserted further (see FIG. 29). As a result the latches 78 are separated from the main receiving portions 27. Moreover, the inner housing 30 is pushed to a loose movement permitting space at the rear of the outer housing 10.

Figure 25A:
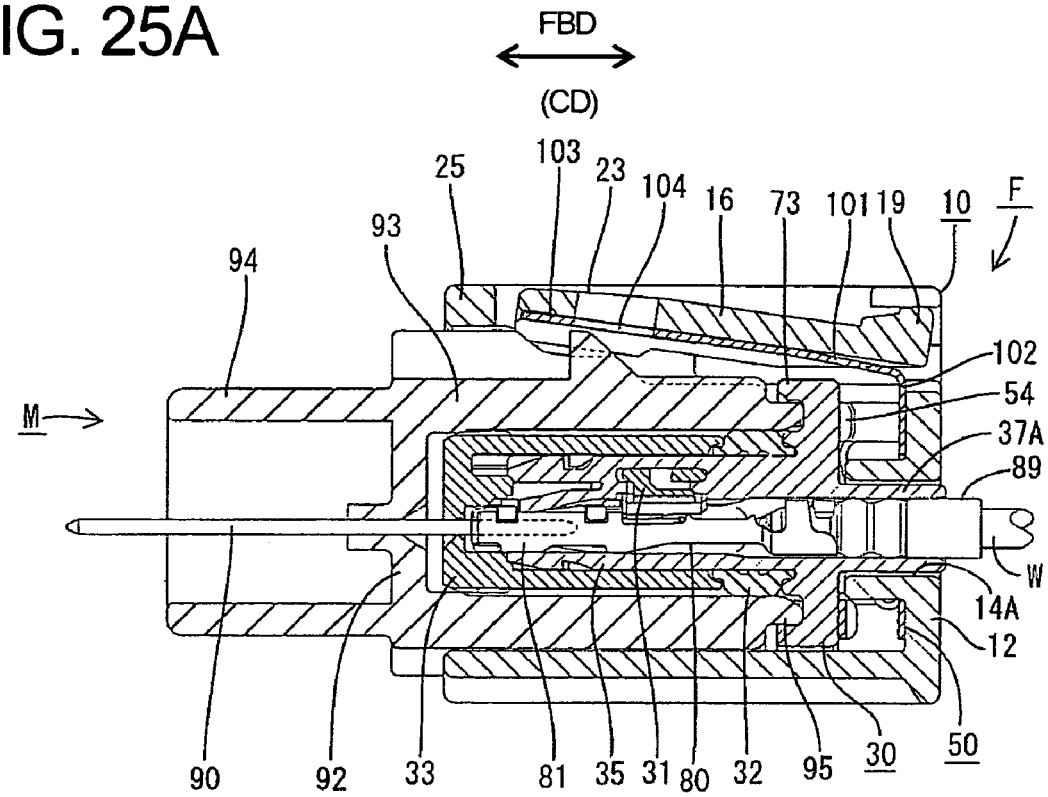
FIG. 25A is a side sectional view of the connectors when the lock arm moves over an interlocking portion at a final stage of the connection.
Figure 25B:
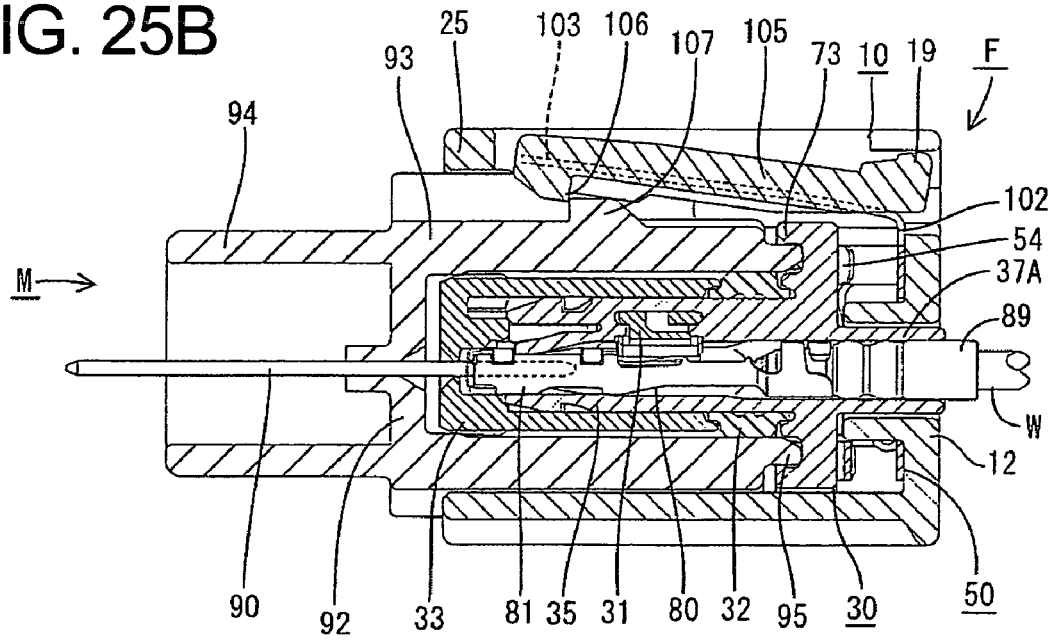
FIG. 25B is a side sectional view of two connectors when the lifting portions move over the interacting portions at the final stage of connection.

The lifting portions 106 move onto the guiding surfaces 107A of the interacting portions 107 before the lock arm 16 does and substantially when the pushing portion 95 of the receptacle 93 is pushed against the front surface of the flange 36, as shown in FIG. 24B. The lock arm 16 is unitary to the lifting portions 106 and is lifted as the lifting portions 106 move onto the guiding surfaces 107A. The lock arm 16 has reached a position corresponding to the interlocking portion 97 in the state as shown in FIG. 24A. However, the lock arm 16 is above the guiding surface 97A of the interlocking portion 97 and does not contact with the interlocking portion 97. When the connecting operation proceeds and the lifting portions 106 reach positions where they can move over the interacting portions 107, as shown in FIG. 25B, the lock arm 16 also reaches a position where it can move over the interlocking portion 97 as shown in FIGS. 25A and 27, but does not interfere with the interlocking portion 97.

Figure 26A:
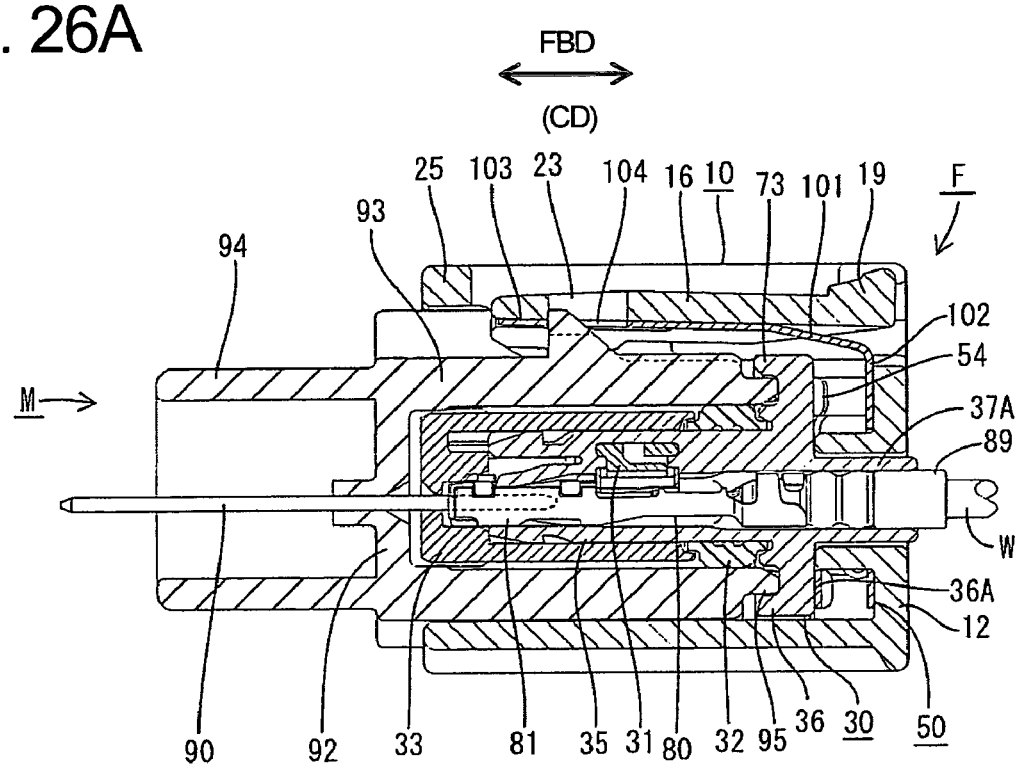
FIG. 26A is a side view of the two connectors properly connected to engage the lock arm and the interlocking portion.
Figure 26B:
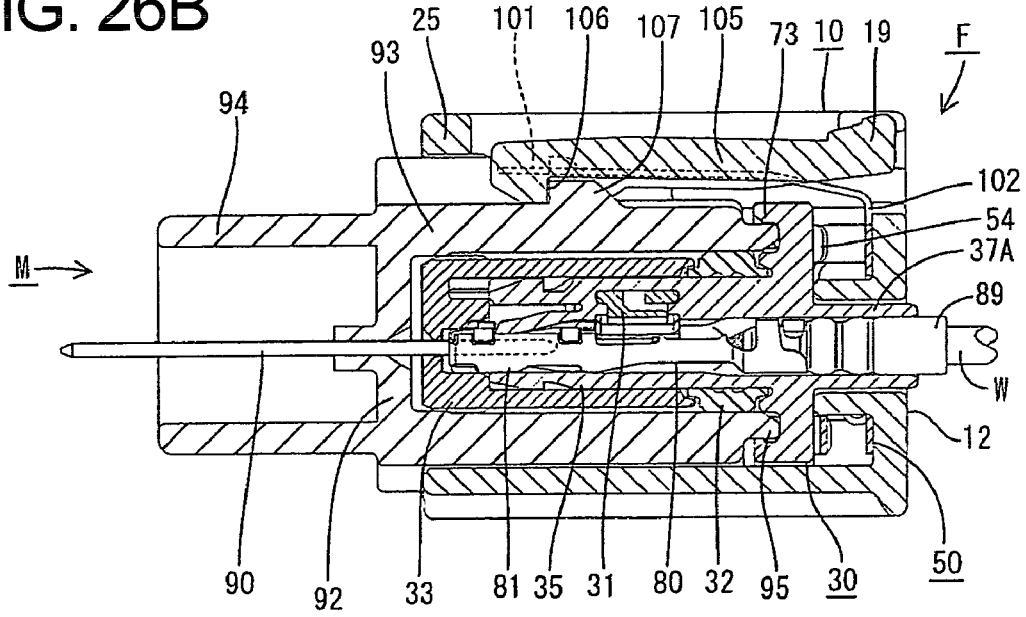
FIG. 26B is a side view in section of the two connectors properly connected to engage the lifting portions and the interacting portions.
Figure 29:
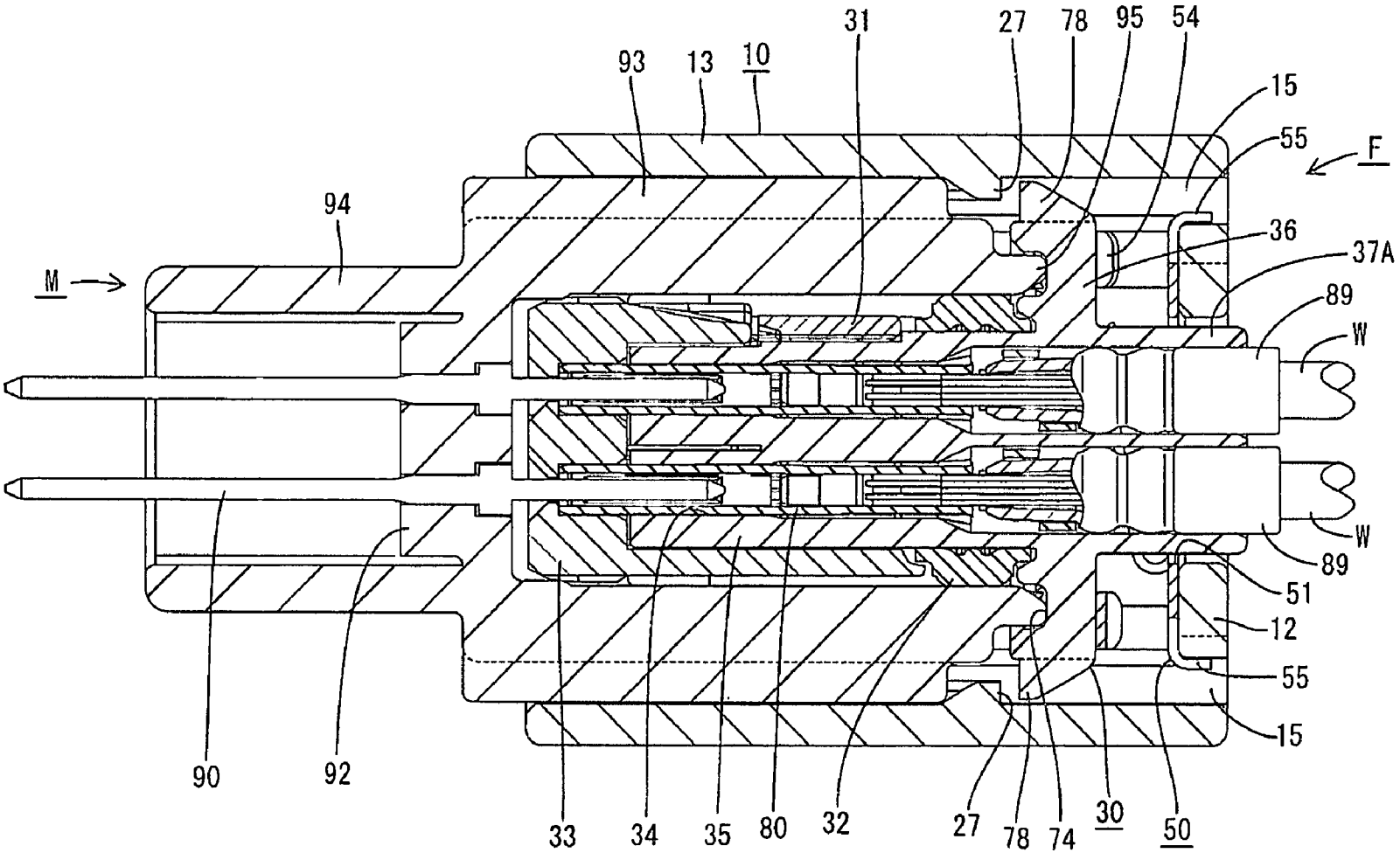
FIG. 29 is a horizontal section of the connectors properly connected.
Figure 30:
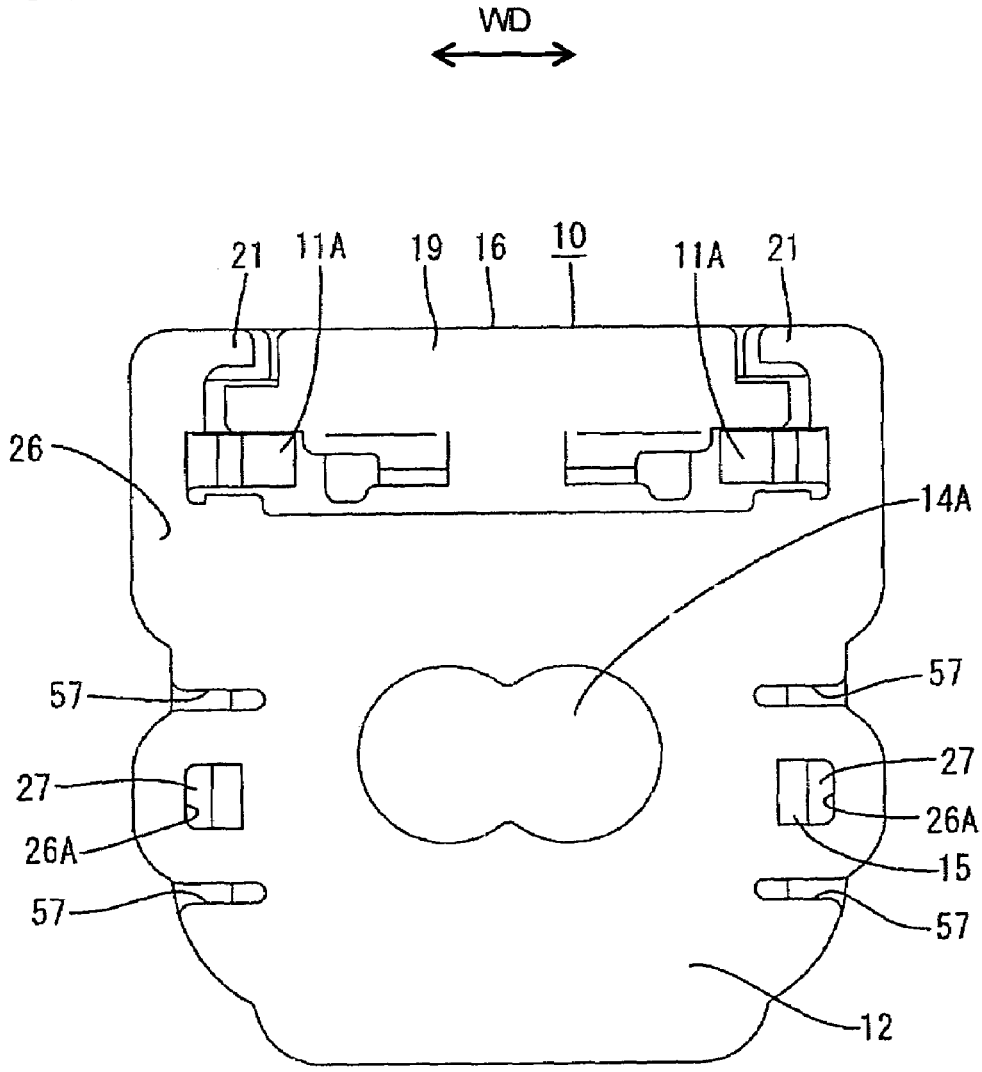
FIG. 30 is a rear view of the outer housing.
Figure 31:
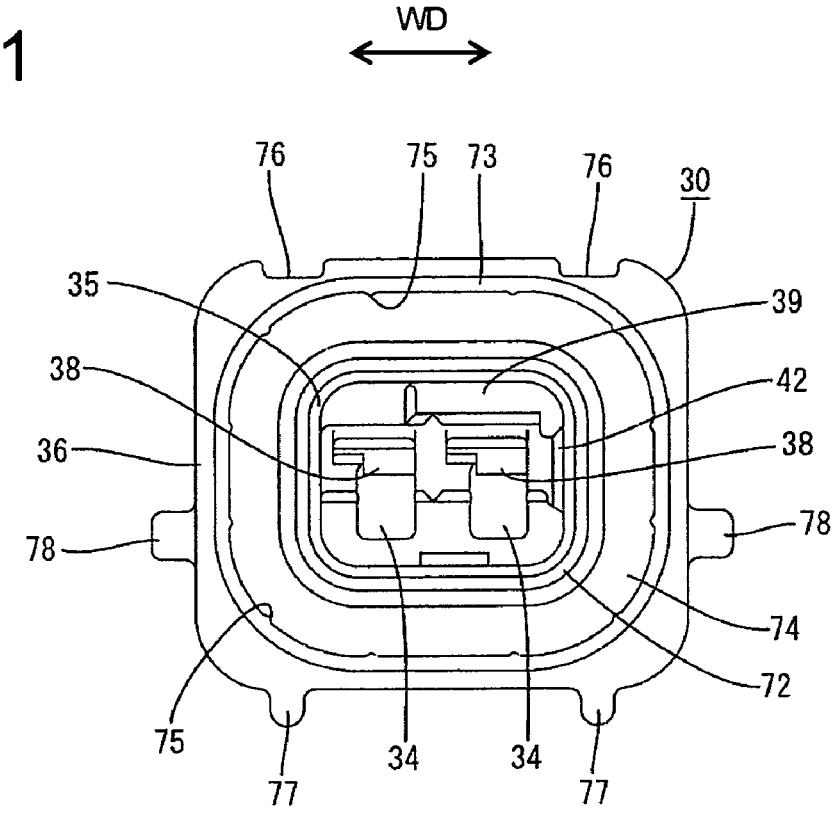
FIG. 31 is a front view of the inner housing.
Figure 32:
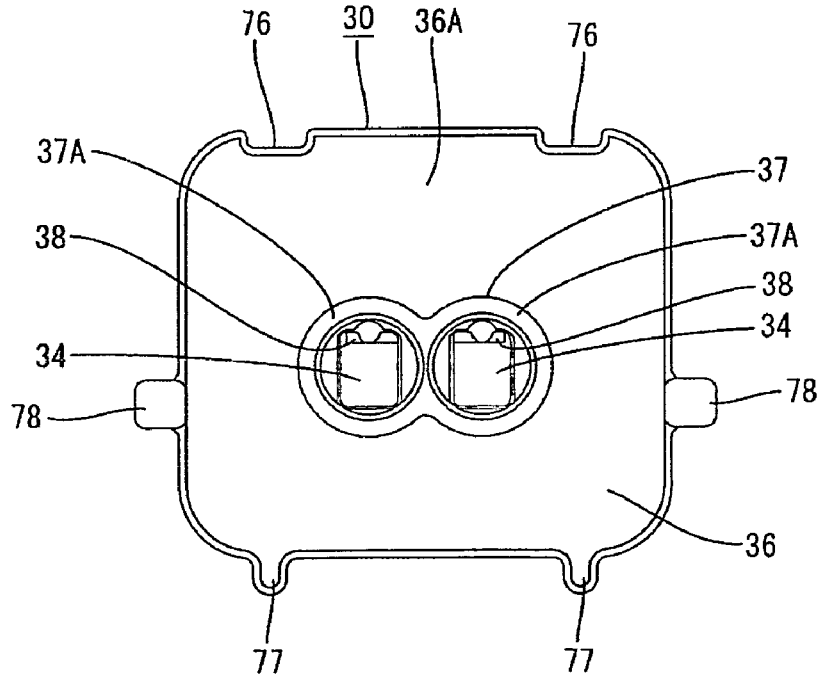
FIG. 32 is a rear view of the inner housing.
Figure 33:
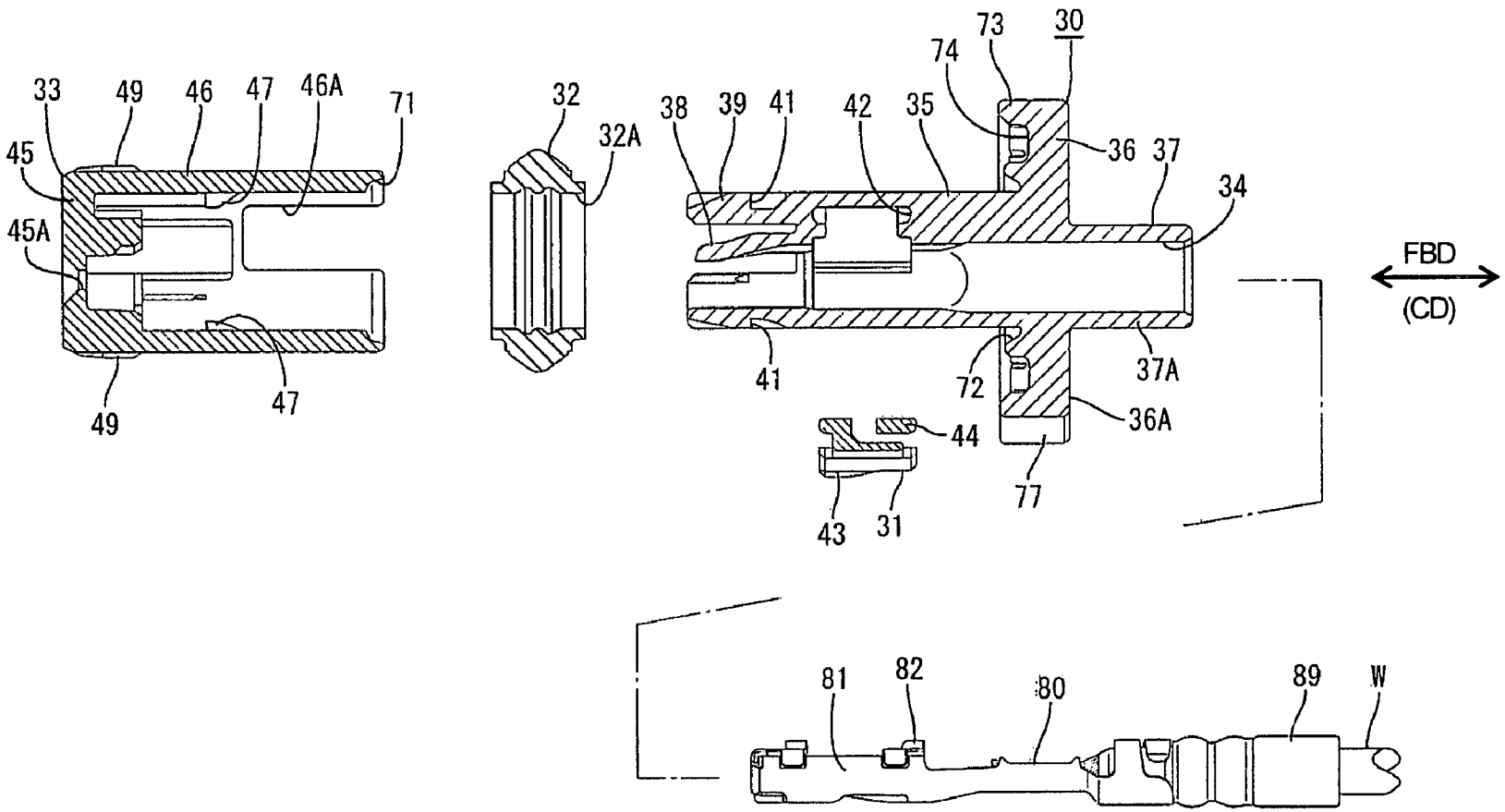
FIG. 33 is a side view in section of the inner housing and parts to be assembled with the inner housing.
Figure 34A:
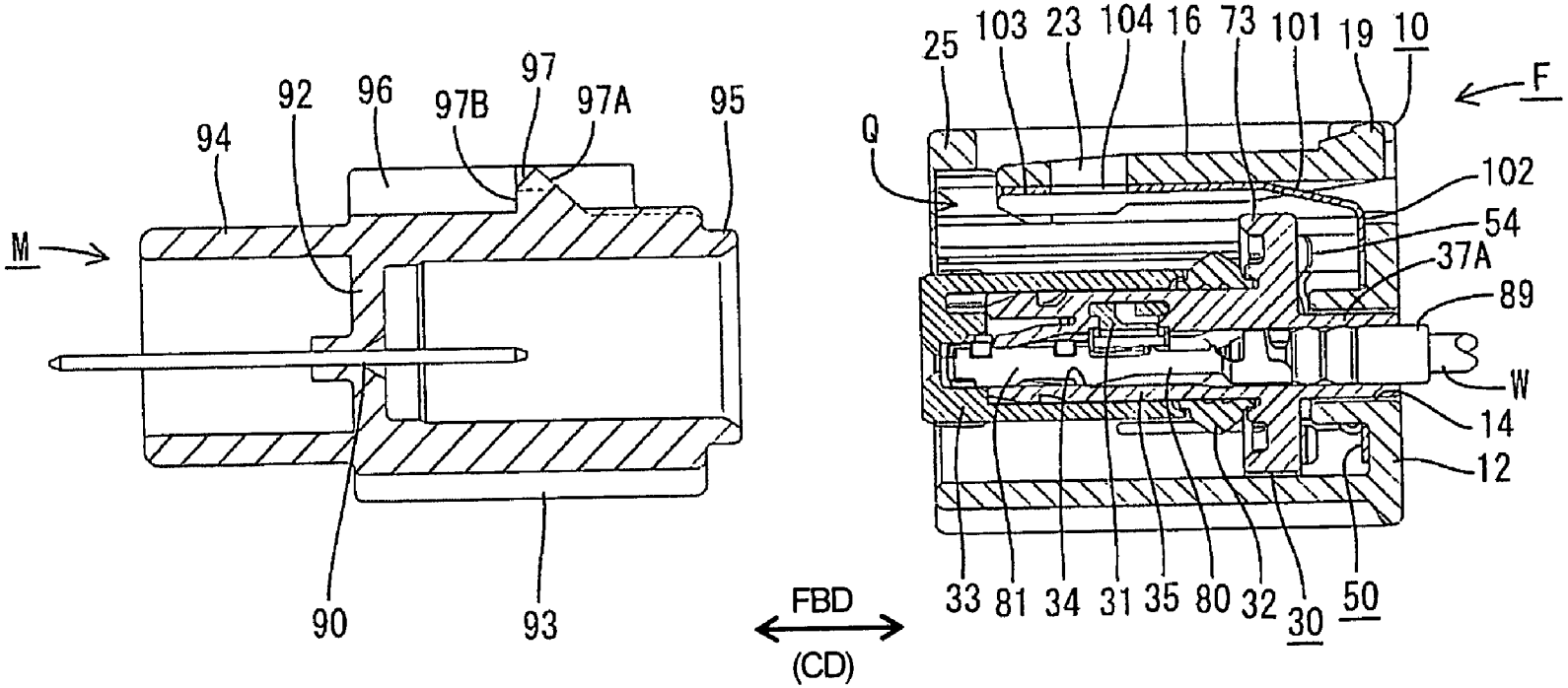
FIG. 34A is a side view in section of the two connectors before being connected showing the lock arm and the interlocking portion.
Figure 34B:
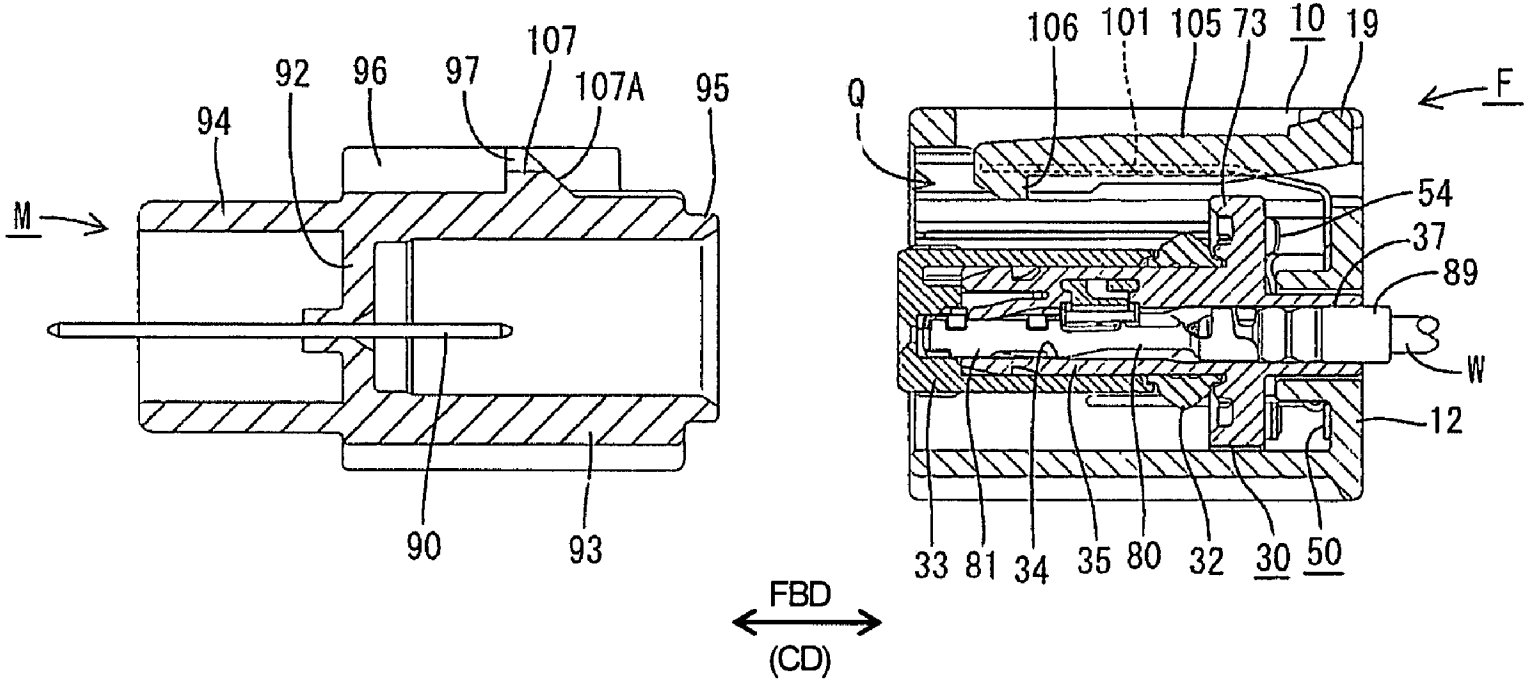
FIG. 34B is a side view in section of the two connectors before being connected showing lifting portions and interacting portions.
Figure 35:
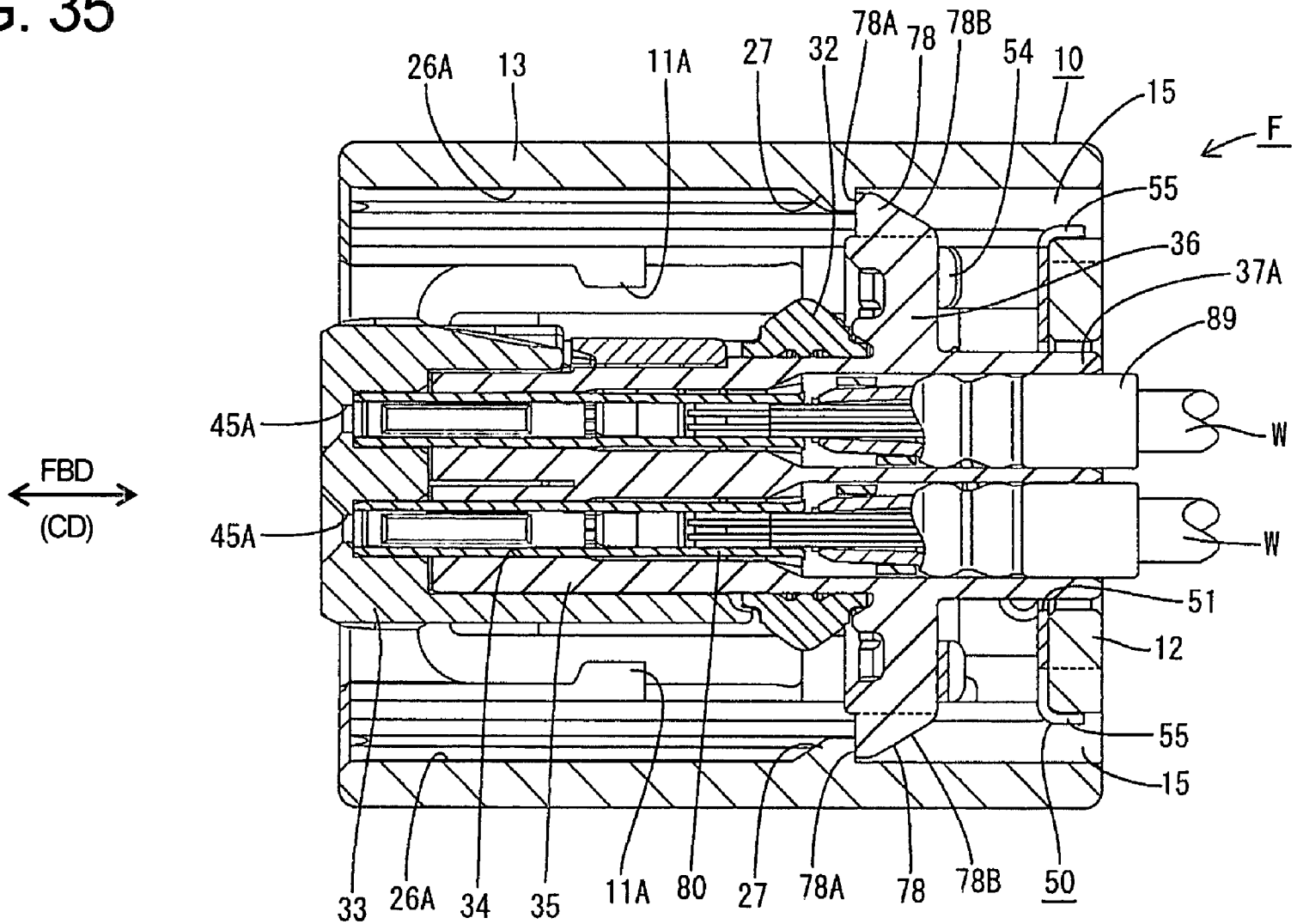
FIG. 35 is a horizontal section of the female connector.

The lifting portions 106 move over the interacting portions 107 when the two connectors F, M are connected properly and the lock arm 16 is restored resiliently together with the widened portions 105. Thus, the lock arm 16 and the interlocking portion 97 are engaged in separating directions of the two connectors F, M. The lifting portions 106 and the interacting portions 107 also are engaged with each other in separating directions of the two connectors F, M, as shown in FIGS. 26A and 26B. As a result, the two connectors F, M are held together. The reinforcing plate 101 on the lock arm 16 does not contact the locking surface 97B of the interlocking portion 97 until the two connectors F, M are connected properly. The latches 78 are separated from the receiving portions 29 (not including the loose movement preventing portions 28) and the inner housing 30 enters the loose movement permitting space, as shown in FIG. 29 when the two connectors F, M are connected properly.

According to the second embodiment, the metallic reinforcing plate 101 is mounted to the lock arm 16 to prevent creep of the resin of the lock arm 16 after the two connectors F, M are connected.

The lifting portions 106 move onto the interacting portions 107 in the process of connecting the two connectors F, M and lift the lock arm 16 to a position to avoid interference with the interlocking portion 97. Thus, the interlocking portion 97 is not abraded by the reinforcing plate 101 and a good locking function can be maintained.

The reinforcing plate 101 is an extension of the spring 50. Thus, there is no need to produce the reinforcing plate 101 and the spring 50 separately. Accordingly, the number of parts can be reduced and the construction can be simplified.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The spring is made of a leaf spring material in the foregoing embodiments. However, the spring member may be, for example, a coil spring or a member made of a cushioning material such as rubber or any other resilient material according to the invention.

The loose movement preventing portions are in the receiving portions in the foregoing embodiments. However, they may be in the latches according to the present invention. In short, it is sufficient for the loose movement preventing portions to surround three sides of the latches or the receiving portions when they are engaged to prevent loose movements thereof.

The loose movement preventing portions prevent loose movement of the latches and the receiving portions when being engaged with each other in the foregoing embodiments. However, it is sufficient to provide protrusions for filling clearances between the latches and the receiving portions, so that the latches and the receiving portions can be engaged rigidly by the protrusions.

The latches and the receiving portions engage to lock the inner housing in the outer housing in the foregoing embodiments. However, the latches and the receiving portions may not be provided with such a locking mechanism according to the invention.

The spring has four supports arranged at intervals in the foregoing embodiments. However, the spring may have more or fewer supports according to the present invention.

A reinforcing plate formed separately from the spring may be mounted into the lock arm according to the present invention.

The male connector may be provided with the inner housing, the outer housing, the spring and the like according to the present invention.

The lock arm may have a locking projection engageable with the interlocking portion instead of the locking hole according to the invention.

The male connector may include the lock arm and the female connector may include the interlocking portion according to the present invention.

The metallic reinforcing plate may cover the entire engageable surface of the lock arm according to the invention so that the reinforcing plate contacts the entire locking surface of the interlocking portion.

In view of vibration resistance, the female connector may not be comprised of many components such as the inner housing, but may be an ordinary connector having one housing as a major part.

What is claimed is:

1. A connector, comprising:

an outer housing, at least one receiving portion in the inner surface of the outer housing;

a resilient member at least partly accommodated in the outer housing; and an inner housing at least partly accommodated in the outer housing so that the resilient member is sandwiched between a portion of the inner housing and a portion of the outer housing, the inner housing being configured to be pushed towards the portion of the outer housing and being supported by the resilient member for floating substantially in connecting directions towards and away from the portion of the outer housing, at least one latch on the outer surface of the inner housing, the latch and the receiving portion contacting each other for rigidly mounting the inner housing in the outer housing before mating the connector, and the latch and the receiving portion being separated from each other by a movement of the inner housing during mating of the connector for canceling the rigidly mounted state of the inner housing.

2. The connector of claim 1, wherein the outer housing is substantially tubular and has one end at least partly closed by a back wall, the back wall forming the portion of the outer housing for sandwiching the resilient member.

3. The connector of claim 1, further comprising a loose movement preventing portion for surrounding the outer surface of the latch before mating the connector and preventing the inner housing from loosely moving substantially normal to the connecting directions, the outer surface of the latch and the loose movement preventing portion sliding on each other during a connecting operation, and the inner housing moving to a loose movement permitting space for permitting loose movements of the inner housing after mating the connector.

4. A connector, comprising:

an outer housing;

a resilient member at least partly accommodated in the outer housing, the resilient member having at least three resilient supports arranged at substantially even internals around a periphery of the resilient member; and an inner housing at least partly accommodated in the outer housing so that the resilient member is sandwiched between a portion of the inner housing and a portion of the outer housing, the inner housing being configured to be pushed towards the portion of the outer housing and being supported by the resilient member for floating substantially in connecting directions towards and away from the portion of the outer housing, wherein the resilient supports of the resilient member press the portion of the inner housing away from the portion of the outer housing.

5. A connector comprising:

an outer housing, wherein the outer housing is made of a synthetic resin and includes a resiliently deformable lock arm, a reinforcing plate being mounted to the lock arm to cover at least part of a surface of the lock arm;

a resilient member at least partly accommodated in the outer housing; and an inner housing at least partly accommodated in the outer housing so that the resilient member is sandwiched between a portion of the inner housing and a portion of the outer housing, the inner housing being configured to be pushed towards the portion of the outer housing and being supported by the resilient member for floating substantially in connecting directions towards and away from the portion of the outer housing.

6. The connector of claim 5, wherein the resilient member is made of a metallic leaf spring material, and the reinforcing plate is formed unitarily with the resilient member by extending a part of the leaf spring material substantially along at least part of a surface of the lock arm.

7. A connector assembly, comprising:

a first connector shaving an outer housing with an open front end and a rear wall, an inner housing accommodated in the outer housing for movement between front and rear positions in the outer housing, a resilient member sandwiched between a rear portion of the inner housing and the rear wall of the outer housing, the resilient member being configured for biasing the inner housing towards the front position in the outer housing, at least one receiving portion on an inner surface of the outer housing, at least one latch on the outer surface of the inner housing, the latch and the receiving portion contacting each other for rigid but releasable mounting of the inner housing in front position in the outer housing; and a second connector with a receptacle having a surrounding wall insertable along a connecting direction into a space between the outer and inner housings, the second connector pushing the inner housing towards the rear position in the outer housing so that the latch separates from the receiving portion for canceling the rigid mounting of the inner housing and so that the resilient member permits float of the inner housing along the connecting directions.

8. The connector assembly of claim 7, further comprising a loose movement preventing portion adjacent the latch before connecting the connectors and preventing the inner housing from loosely moving normal to the connecting direction, the latch and the loose movement preventing portion separating during connection for permitting loose movements of the inner housing after mating the connectors.

9. The connector assembly of claim 7, further comprising a flange bulging out from an outer surface of the inner housing, a seal mounted on the outer surface of the inner housing adjacent the flange, a deformation preventing portion provided at an outer part of the flange and facing the seal, the surrounding wall of the receptacle being engaged between the deformation preventing portion and the seal, whereby the surrounding wall of the receptacle squeezes the seal against the inner housing, and the deformation preventing portion prevents the surrounding wall of the receptacle from widening.

10. The connector assembly of claim 7, wherein the outer housing is made of a synthetic resin and includes a resiliently deformable lock arm, the second connector including an interlocking portion formed from a synthetic resin that is harder than the synthetic resin of the outer housing, the surrounding wall of the receptacle of the connector being held in the outer housing by engaging the lock arm with the interlocking portion, a reinforcing plate being mounted to the lock arm to cover at least part of a surface of the lock arm to be held in contact with the interlocking portion.

11. The connector assembly of claim 10, wherein the lock arm has at least one lifting portion, and the receptacle has at least one interacting portion adjacent the interlocking portion, the lifting portion moving onto the interacting portion to lift the lock arm during a connecting operation so that the lock arm and the interlocking portion do not interfere with each other.

12. The connector of claim 10, wherein the resilient member is made of a metallic leaf spring material, and the reinforcing plate is formed unitarily with the resilient member by extending a part of the leaf spring material substantially along at least part of a surface of the lock arm.

* * * * *